US005457978A

United States Patent [19]

Bogart et al.

[11] Patent Number: 5,457,978

[45] Date of Patent: Oct. 17, 1995

[54] CARTRIDGE FED APPARATUS FOR FORMING CURVED RECTANGULAR BODIED NEEDLES

[75] Inventors: Michael W. Bogart, Milford; Richard J. Smith, Stamford, both of Conn.

[73] Assignee: United States Surgical Corporation, Norwalk, Conn.

[21] Appl. No.: 135,603

[22] Filed: Oct. 8, 1993

Related U.S. Application Data

[63] Continuation-in-part of Ser. No. 958,926, Oct. 9, 1992.

[51] Int. Cl.[6] ..... B21G 1/00

[52] U.S. Cl. ..... 72/133; 72/403; 72/405; 72/470; 163/1; 163/5

[58] Field of Search ..... 72/133, 403, 405, 72/384, 469, 470, 472; 163/1, 5; 198/345.1; 414/225, 226, 287

[56] References Cited

U.S. PATENT DOCUMENTS

| | | | |
|---|---|---|---|
| 1,637,030 | 7/1927 | Thyssen | 163/1 |
| 1,697,896 | 1/1929 | Yates . | |
| 1,735,759 | 11/1929 | Hofmann et al. | 163/1 |
| 2,309,963 | 2/1943 | Krueger . | |
| 2,756,803 | 7/1956 | Faeber | 72/166 |
| 2,990,001 | 6/1961 | Hansen | 72/166 |
| 3,040,798 | 6/1962 | Johnson | 72/172 |
| 3,112,087 | 11/1963 | Fornataro | 72/166 |

(List continued on next page.)

FOREIGN PATENT DOCUMENTS

| | | | |
|---|---|---|---|
| 0286438 | 10/1988 | European Pat. Off. . | |
| 8873989 | 4/1988 | Japan . | |
| 63-309338 | 12/1988 | Japan . | |
| 0299834 | 12/1988 | Japan | 163/1 |
| 3277373 | 12/1991 | Japan . | |
| 54818 | 6/1942 | Netherlands . | |

OTHER PUBLICATIONS

Abstract of Japanese Patent Publication No. 1138030 (May 30, 1989).

Abstract of Japanese Patent Publication No. 3251357 (Nov. 8, 1991).

Abstract of Japanese Patent Publication No. 3254324 (Nov. 13, 1991).

Abstract of Japanese Patent Publication No. 60048249 (Mar. 15, 1985).

Search Report from corresponding European Patent Application No. 94115233.2.

*Primary Examiner*—Lowell A. Larson
*Assistant Examiner*—Thomas C. Schoeffler

[57] ABSTRACT

An apparatus having a frame; a shuttle member, adapted to receive and hold a needle blank, and movably mounted to the frame; a clamp member detachably mounted on the frame for supplying needle blanks to the shuttle member; a transfer mechanism mounted on the frame for facilitating the transfer of the needle blanks from the clamp member to the shuttle member; a press mechanism for imparting first flat surfaces to first opposing sides of the needle blanks held by the shuttle member; a mandrel mounted on the frame for imparting an arcuate profile to the needle blanks; a transport mechanism for transporting the needle blanks from the shuttle member to the mandrel; and a needle side press for imparting second flat surfaces to second opposing sides of the needle blanks. A method of forming a curved, rectangular bodied needle from substantially round-elongated needle blanks is also disclosed and comprises the steps of: transferring needle blanks from a clamp to a holding shuttle having die surfaces on needle engaging faces thereof; flat pressing first opposing sides of the needle blanks between die surfaces; transporting the needle blanks from the shuttle onto a rotatable mandrel; curving the needle blanks between the rotatable mandrel and a reciprocable belt; rotating the needle blanks about the mandrel and adjacent side press dies and depositing the needle blanks therebetween; and side pressing second opposing sides of the needle blanks between side press dies.

31 Claims, 14 Drawing Sheets

U.S. PATENT DOCUMENTS

| | | | |
|---|---|---|---|
| 3,357,222 | 12/1967 | Konstandt | 72/146 |
| 3,994,656 | 11/1976 | Van Ausdall | 72/170 |
| 4,063,442 | 12/1977 | Martin, Sr. | 72/166 |
| 4,378,592 | 3/1983 | Heilberger et al. | 72/405 |
| 4,524,771 | 1/1985 | McGregor et al. . | |
| 5,041,127 | 8/1991 | Troutman | 606/223 |
| 5,282,715 | 2/1994 | Abbate et al. | 414/757 |
| 5,287,721 | 2/1994 | Samsel | 72/400 |
| 5,351,518 | 10/1994 | Bogart et al. | 72/403 |

FIG.5
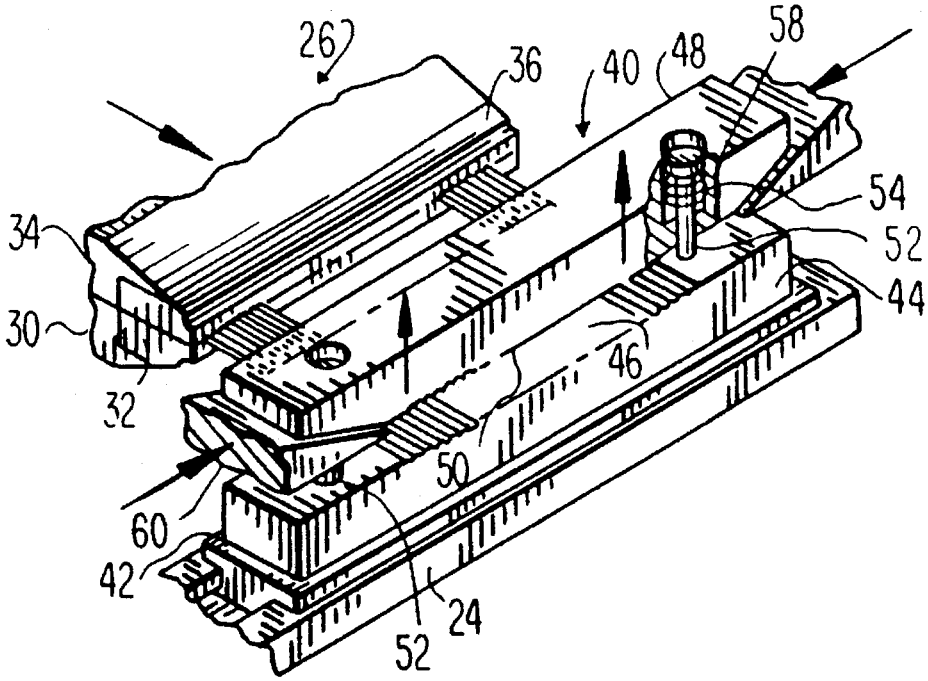
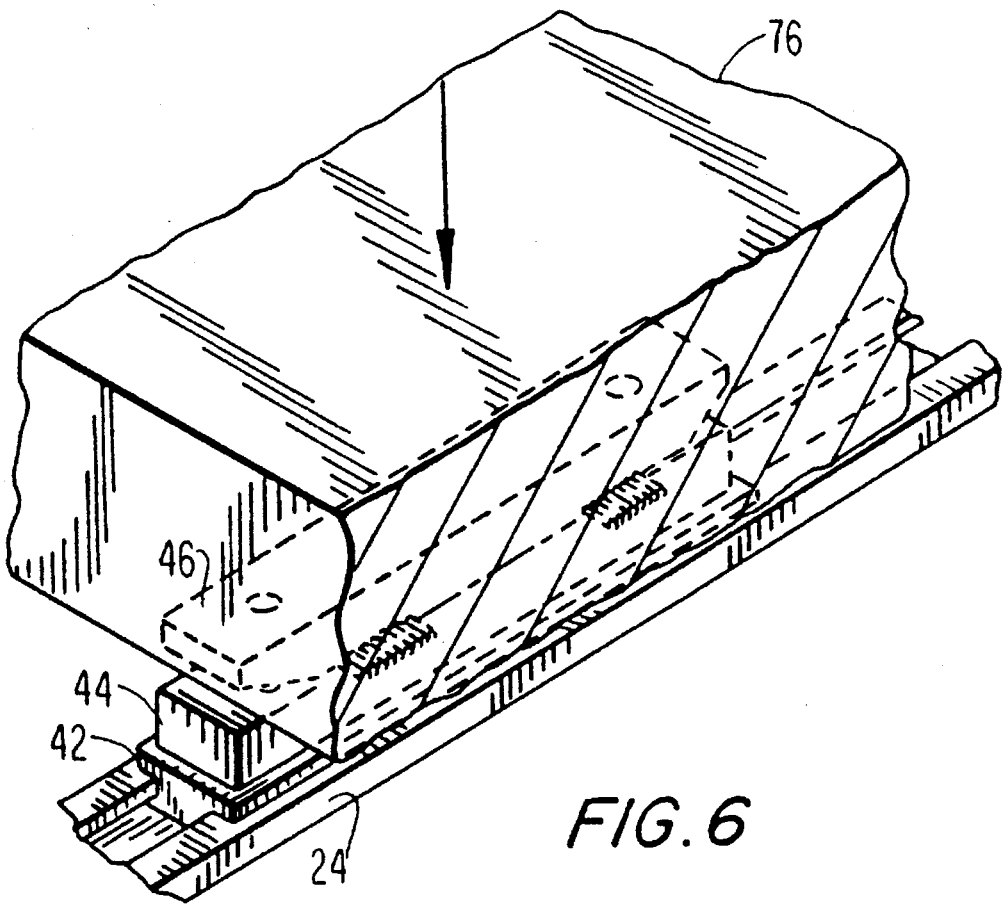
FIG.6

CARTRIDGE FED APPARATUS FOR FORMING CURVED RECTANGULAR BODIED NEEDLES

CROSS REFERENCE TO RELATED APPLICATION

This application is a continuation-in-part of copending prior application Ser. No. 07/958,926 filed Oct. 9, 1992, entitled NEEDLE CURVING APPARATUS, the disclosure of which is incorporated by reference herein.

BACKGROUND OF THE INVENTION

1. Field of the Invention

The present invention relates to needle forming devices. More particularly, the invention relates to a cartridge fed multistation needle forming apparatus for transferring a plurality of needle blanks from a needle grinding cartridge to a shuttle member and thereafter flat pressing, curving and side pressing the needle blanks, to form curved rectangular bodied needles. The apparatus is also capable of transporting the needle blanks from the shuttle member to a curving station.

2. Description of the Related Art

The production of needles involves many processes and different types of machinery in order to prepare quality needles from raw stock. These varying processes and machinery become more critical in the preparation of surgical needles where the environment of intended use is in humans or animals. Some of the processes involved in the production of surgical grade needles include, straightening spooled wire stock; cutting needle blanks from raw stock; tapering or grinding points on one end of the blank; providing a bore for receiving suture thread at the other end of the blank; and imparting flat surfaces on opposite sides of the blank by flat pressing a portion of the needle blank to facilitate grasping by surgical instrumentation and curving the needle where curved needles are desired. Additional processing may be done to impart flat surfaces substantially perpendicular to the flat pressed portions of the needle blank by side pressing a portion of the needle blank to further facilitate grasping by surgical instrumentation and insertion into humans or animals.

Conventional needle processing is, in large part, a labor intensive operation requiring highly skilled labor. Generally, extreme care must be taken to ensure that only the intended working of the needle is performed and the other parts of the needle remain undisturbed.

Curved rectangular bodied needles have advantages over other needle configurations in many surgical procedures for a variety of reasons including, uniformity of entry depth for multiple sutures and proper "bite" of tissue surrounding the incision or wound. When providing curved rectangular bodied needles for surgical procedures it is desirable for the needles to have a specified rectangular cross-section and a specified curvature, i.e., a predetermined radius of curvature. The desired cross-section and radius of curvature for the finished needle varies with specific applications.

Conventional methods of forming curved rectangular bodied needles require several separate and distinct operations on various machinery. The needle blank must first be flat pressed to impart initial flat surfaces along barrel portions of the needle blanks located between a tapered point end of the blank and a drilled end. After flat pressing, the needle blank can then be taken from the flat press dies to a curving machine to impart the proper curvature to the needle blank. Care must be taken when removing the blanks from the flat press dies and positioning the needle blank in the curving machinery to avoid disturbing the flat surfaces imparted by the flat pressing operation.

After curving, the flat pressed and curved needle blanks can then be taken from the curving anvil to a side press station to impart flat surfaces substantially perpendicular to the flat pressed sides to give the final rectangular cross sectional profile to the needle barrel. Again care must be taken during removal of the needle blanks from the curving anvil and during side pressing so as to avoid disturbing the previously imparted flat pressed and curved portions of the needle blank.

Known flat pressing techniques create the flat edges on the needle barrel by pressing the barrel portion of the needle blank between a pair of opposing needle dies having the desired length and width characteristics. Typically, the needle blanks are inserted into a lower die and compressed between the dies to impart the flat surfaces on opposed sides of the needle barrels . The flat pressed blanks can then be removed from the dies and taken to the curving machinery. After removal of the needle blanks, the dies can also be inspected to ensure that no needle blanks remain stuck to one of the dies.

Known needle curving techniques create the curve in the needle by bending the needle blank around an anvil structure having the desired curvature. To attain the desired needle configuration, the anvil structure provides a shaping surface for deforming the needle. Typically, the needle is positioned for curving by manually placing the needle for engagement with the anvil structure and holding it in place by a holding device. The needle is subsequently bent by manipulating the holding device so the needle curvature is formed about the shaping surface of the anvil structure. Needles improperly positioned on the anvil may result in a deformation of the previously imparted flat press sides and may have to be reprocessed or discarded.

When needles are made of steel or similar resilient materials, the anvil or mandrel used should have a smaller radius than the radius desired in the final needle. This configuration allows for some springback after the bending operation and ensures that the desired radius of curvature is attained. One disclosure of such features may be found in, for example, McGregor et al U.S. Pat. No. 4,534,771.

After flat pressing and curving the needle blank it may be desirable to side press the barrel portion of the needle blank to obtain a rectangular cross-section in the needle barrel. As with the above flat press process, known side pressing techniques require inserting the blank between a pair of dies to compress and impart flat sides to the needle blank. Needles improperly positioned within the dies may become deformed and also have to be discarded or reprocessed.

One disadvantage to conventional needle forming techniques is that after grinding taper points or drilling suture holes in the needle blanks, the individual needle blanks must be removed from the grinding/drilling clamps and manually placed in a needle pressing apparatus to continue the pressing of the needle blanks. Another disadvantage to conventional needle forming techniques is that typically only one needle processing operation at a time, such as, for example, flat pressing between a pair of dies, curving around an anvil structure or side pressing between another set of dies, can be performed on a single piece of machinery. A further disadvantage is the long processing time and high costs required in forming and moving the needle blanks between the various machinery. Lastly, a still further disadvantage is the need to readjust several pieces of machinery to process needles of varying lengths and diameters thereby further increasing production time and costs.

Therefore a need exists for a single needle forming apparatus that is capable of flat pressing, curving, and side pressing a multiplicity of needle blanks or a single needle blank by moving the needle blanks directly between the various operations. It is also desirable to provide a needle forming apparatus which can sequentially load and position one or more needle blanks at a first processing station so as to increase the production rate of the needle manufacturing process by increasing the flow of needle blanks through the apparatus. The present invention relates to such an apparatus and method of forming such needles.

SUMMARY OF THE INVENTION

An apparatus for forming curved, rectangular bodied surgical needles is disclosed which includes: needle blank holding means for holding at least one needle blank; means for supplying the at least one needle blank to the needle blank holding means for receipt thereof; transfer means associated with the needle blank holding means and the supply means for transferring the at least one needle blank from the supply means to the needle blank holding means; and means associated with the needle blank holding means for imparting first flat surfaces to first opposing sides of the at least one needle blank.

The needle blank holding means preferably includes a shuttle member having an upper half and a lower half biased together by a pair of springs and adapted to hold a plurality of needle blanks between inner surfaces of the upper and lower halves. The supply means is a detachable clamp member having an upper jaw, a lower jaw and lever means for moving the upper jaw with respect to the lower jaw. Releasing means are provided for moving the lever means, such that when the lever means is in a first position, the needle blanks are firmly clamped between the upper and lower jaws of the clamp member and when the lever means is moved to a second position by the lever moving means, the needle blanks are releasably supported by the lower jaw.

The transferring means includes: first separating means for separating the upper and lower halves of the shuttle member against the spring bias; means for positioning the needle blanks between the inner surfaces of the separated upper and lower halves; and means for releasing the needle blanks from the supply means. The upper and lower halves of the shuttle member grip the needle blanks positioned therebetween when the separating means is removed. The first separating means includes a pair of movable wedge members, the wedge members movable between a position remote from the shuttle member and a position between the upper and lower halves of the shuttle member to thereby separate the upper and lower halves apart against the bias.

The apparatus further includes means associated with the frame for imparting a curved profile to the needle blanks and means for transporting the needle blanks between the shuttle member and the curving means, wherein the shuttle member is movable from a second position adjacent the compressing means to a third position adjacent the transporting means. The transporting means includes second separating means for separating the upper and lower halves of the shuttle member; needle blank removing means for removing the needle blanks from the shuttle member; and means for positioning the needle blanks adjacent the curving means. The second separating means includes a pair of wedge members similar to those of the first separating means to separate the upper and lower halves apart. The needle blank removing means includes a movable plate member having a plurality of needle pushing fingers along one edge thereof, the plate member movable from a position remote from the shuttle member to a position adjacent a first side of the shuttle member such that the fingers push a plurality of the needle blanks toward a second side of the shuttle member.

The positioning means preferably includes a movable block member, having a plurality of transverse bores therein, which is movable from a first position adjacent the second side of the shuttle member for receipt of the needle blanks therefrom to a second position adjacent the curving means. The needle blanks are pushed by the needle pushing fingers out of the shuttle member and into the bores when the block member is adjacent the second side of the shuttle member. The shuttle member is adapted to hold approximately ninety needle blanks. The movable plate member has approximately three needle pushing fingers to push approximately three needle blanks at a time from the shuttle member.

The curving means is preferably a mandrel for imparting an arcuate profile to at least a portion of the needle blanks; and reciprocating means for biasing and reciprocally moving the at least needle blanks against the mandrel. The reciprocating means cooperates with the mandrel to accept the needle blanks therebetween from the transporting means. The mandrel is a rotatable shaft having at least a portion thereof configured to impart the arcuate profile to the needle blanks and has a predetermined radius of curvature in the range of between about 0.05 inches and about 3.00 inches. The reciprocating means comprises: at least one pair of rotatable members positioned in adjacency; and a belt positioned about the at least one pair of rotatable members for biasing and reciprocally moving the needle blanks against the mandrel. The reciprocating means further comprises belt drive means for selectively moving the belt and tensioning means for applying tension to the belt. The tensioning means includes at least one tensioning roller biased toward the belt. The belt is fabricated from a material selected from the group of materials consisting of Neoprene, Nylon, Polyurethane or Kevlar. The curving means further comprises biasing means for applying a continuous force to at least one of the pair of rotatable members such that a friction fit is maintained between the belt, the at least one pair of rotatable members and the needle blanks when the belt is engaged with the reciprocating means.

The apparatus further includes a side press associated with the frame portion for imparting second flat surfaces to opposing sides of the needle blanks, wherein the second flat surfaces are imparted substantially perpendicular to the first flat surfaces. The side press includes side die means for supporting the needle blanks and clamp means for pressing the side die means about the needle blanks to impart the second flat surfaces. The side die means is preferably in the form of a plurality of adjacent plate members, each of the adjacent plate member having at least one die slot coacting with a corresponding die slot in the next adjacent plate member to support a needle blank therebetween. The corresponding die slots cooperate to form a pair of side press dies having lead in tapers of about 3° to about 15° and preferably about 5°. The side die means is rotatable between a first position adjacent the curving means for direct receipt of the needle blanks therefrom to a second position adjacent the clamp means for side pressing the needle blanks therebetween. The side die means is rotatable between the second position adjacent the clamp means to a third position removed from the clamp means.

Means are provided to remove the needle blanks from the side die means when the side die means is in the third position. The removal means is preferablay air jet means to urge the needle blanks free from the side die means.

BRIEF DESCRIPTION OF THE DRAWINGS

Preferred embodiments of the invention are described hereinbelow with reference to the drawings wherein;

FIG. 5 is an enlarged partial perspective view of the needle holding cartridge and shuttle member of the apparatus of FIG. 1;

FIG. 6 is an enlarged partial perspective view of the shuttle member in the flat pressing station of the apparatus;

DETAILED DESCRIPTION OF THE PREFERRED EMBODIMENTS

Figure 1:
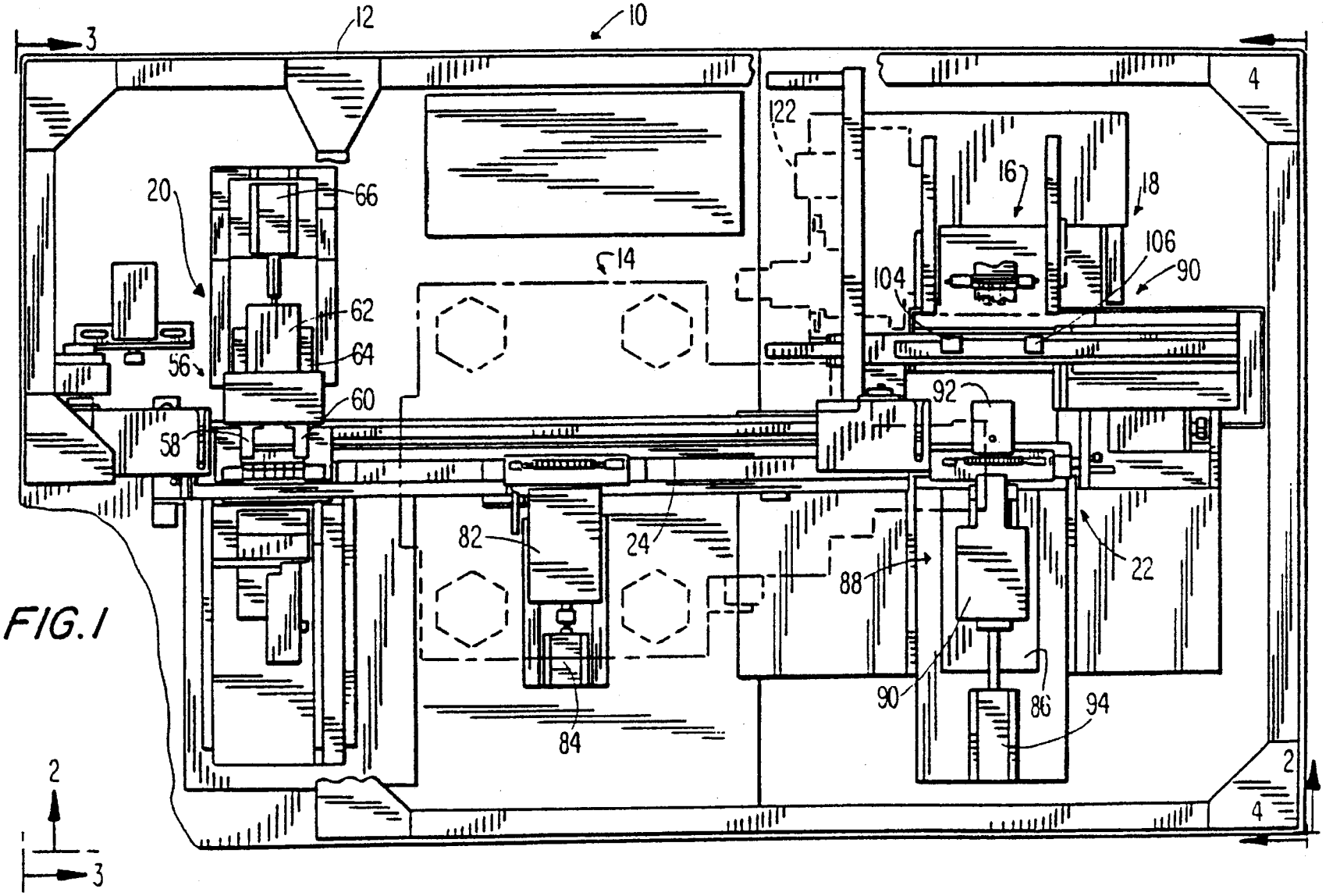
FIG. 1 is a top plan view of the needle forming apparatus of the present invention.

Generally the needle forming apparatus of the present invention is utilized to off load or transfer a plurality of needle blanks from a needle holding or grinding cartridge and then flat press, curve or bend and side press the multiplicity of needle blanks. While the present invention is adapted to simultaneously process a plurality of needle blanks, pressing and curving of a single needle blank is also contemplated. As used herein, the term needle blank refers to a surgical needle in various stages of fabrication.

Needle forming apparatus 10 is illustrated in FIGS. 1–4 and generally includes a support stand or frame member 12, a flat press station 14, a curving station 16 and a side press station 18. Apparatus 10 further includes an off load or transfer station 20 and a transport station 22, both of which are also mounted with respect to frame 12. A trackway 24 extends generally from transfer station 20, under flat press station 14 to transport station 22. A computer control station (not shown) may be provided to sequence and control the motions of various stations of, and thus the flow of needle blanks through, apparatus 10.

Figure 3:
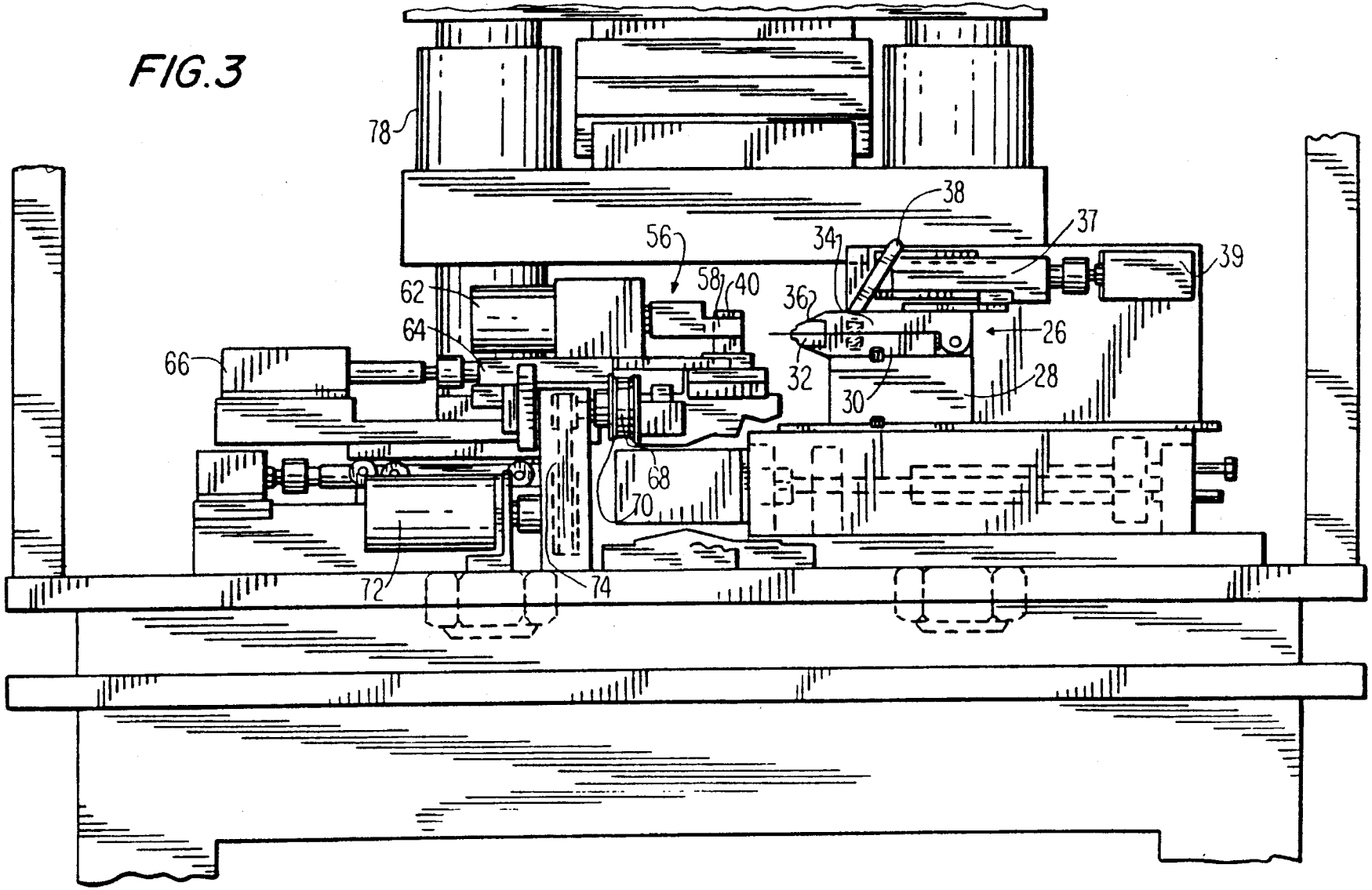
FIG. 3 is a left side elevational view taken along the lines 3—3 of FIG. 1.

In FIG. 1, transfer station 20 is provided to remove a plurality of needle blanks from a detachable needle grinding or holding cartridge and transfer the needle blanks to a shuttle cartridge. Referring now to FIG. 3, needle cartridge 26 is of the type generally used in grinding or holding a plurality of needle blanks and has a lower jaw member 30 having an inner needle holding surface 32, an upper jaw member 34 pivotally connected to lower jaw member 30 and having an inner needle holding surface 36 and lever means 38 adapted to open and close jaw members 30 and 34 to alternately release and hold a plurality of needle blanks between surfaces 32 and 36. The needle cartridge is disclosed in copending, commonly assigned U.S. patent application Ser. No. 07/959,151, filed Oct. 9, 1992 now U.S. Pat. No. 5,282,715 and entitled NEEDLE TRANSPORTING APPARATUS, the disclosure of which is incorporated by reference herein. Needle cartridge 26 mounts to a movable block 28 on frame 12. Preferably, needle cartridge 26 is adapted to hold approximately (90) ninety needle blanks in side to side relationship.

Figure 15:
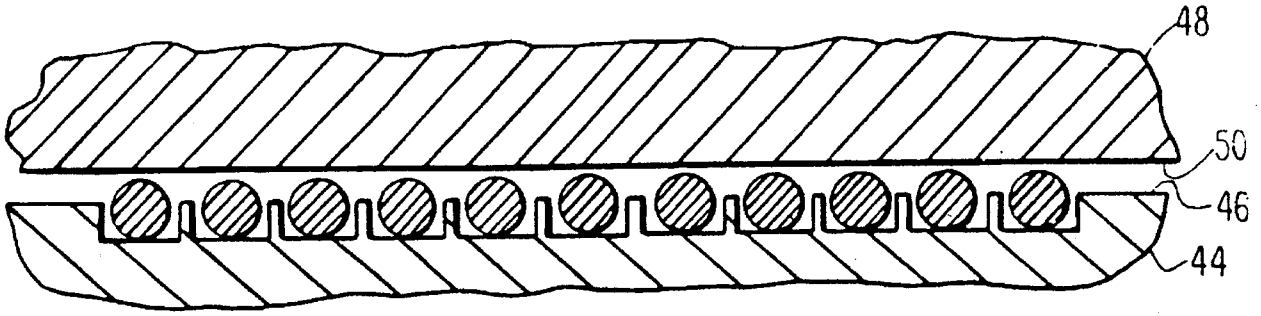
FIG. 15 is an enlarged partial cross-sectional view of the shuttle member holding a plurality of needle blanks.
Figure 16:
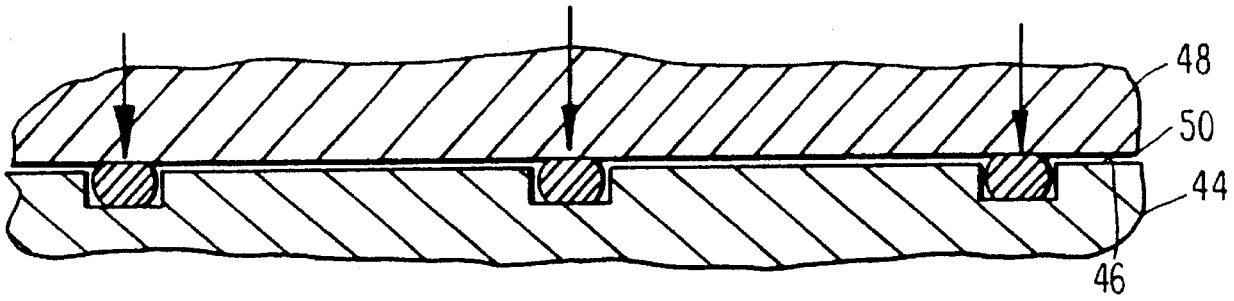
FIG. 16 is an enlarged partial cross-sectional view of the shuttle member at the flat press station illustrating the needle blanks being flat pressed between the upper and the lower surfaces of the shuttle member.
Figure 17:
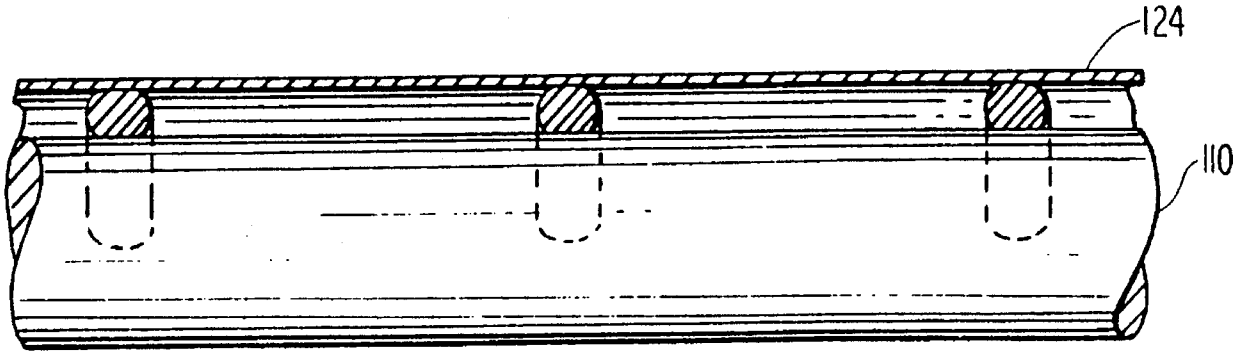
FIG. 17 is an enlarged partial cross-sectional view of the curing station illustrating the needle blanks being curved about the mandrel by the curving belt.

Refering now to FIG. 5, a needle shuttle member 40 includes a base member 42 adapted to slidingly engage trackway 24, a lower shuttle half 44 affixed to base member 42 and having a needle engaging die surface 46, and an upper shuttle half 48 having a needle engaging die surface 50. Upper shuttle half 48 is slidably connected to lower shuttle half 44 by means of pins 52. Springs 54 are provided around pins 52 to bias shuttle halves 44 and 48 together into a closed, needle holding position. Preferably, needle die surfaces 46 and 50 are adapted to hold approximately (90) ninety needle blanks therebetween by milling or forming die surfaces with a pitch of approximately 20 mil to 100 mil. Die surfaces 46 and 50 are flat and are adapted to impart flat surfaces to barrel portions of the needle blanks when halves 44 and 46 are compressed (FIG. 15) at flat press station 14. Upper shuttle half 48 and lower shuttle half 44 may be coated with various materials to help prevent needle blanks from adhering thereto. Upper half 48 and lower half 44 are preferably fabricated from a material having a hardness which is at least substantially equal to the material. Typically halves 44 and 48 have a rockwell hardness value of between 35 to about 70.

As shown in FIGS. 1, 3 and 5, a shuttle separating mechanism 56 is provided to separate shuttle halves 44 and 48 against the bias of springs 54 enabling needle blanks to be positioned therebetween. Separating mechanism 56 includes a pair of movable wedge shaped shuttle engaging jaws 58 and 60. Jaws 58 and 60 are movable from an open position remote from shuttle member 40 to a closed position wherein jaws 58 and 60 abut and wedge apart shuttle halves 44 and 48 as shown in FIG. 5. Jaws 58 and 60 are movable towards and away from each other by means of hydraulic cylinder 62. In the alternative, a pneumatic cylinder (not shown) may be employed instead of hydraulic cylinder 64. Separating mechanism 56 is mounted on a sliding plate member 64 which is moved transversely toward and away from shuttle member 40 by means of hydraulic cylinder 66.

Figure 2:
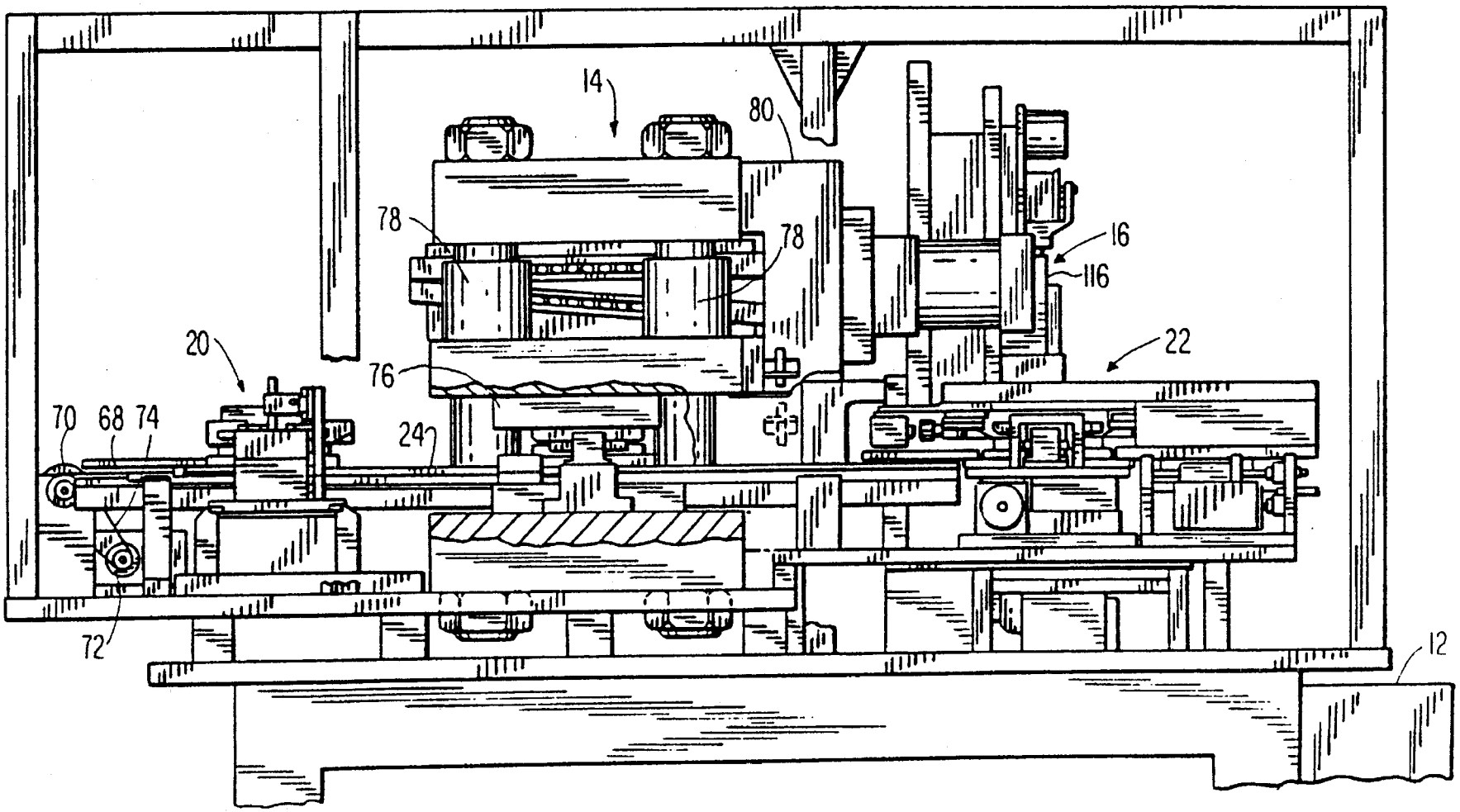
FIG. 2 is a front elevational view taken along the lines 2—2 FIG. 1.

Shuttle member 40 is adapted, dimensioned and configured to reciprocate along trackway 24 between a first position adjacent transfer station 20, to a second position under flat press station 14 and to a third position adjacent transport station 22. As shown in FIGS. 2 and 3, shuttle base 42 is connected to a continuous belt 68 suspended beneath trackway 24. Belt 68 surrounds a drive pulley 70 at one end of trackway 24 and is rotated by means of a motor 72 and drive belt 74. Shuttle 40 is moved from its first position adjacent transfer station 20 to its second position beneath flat press station 14 by drawing shuttle 40 along trackway 24 as motor 72 and thus belt 68 are rotated.

Figure 4:
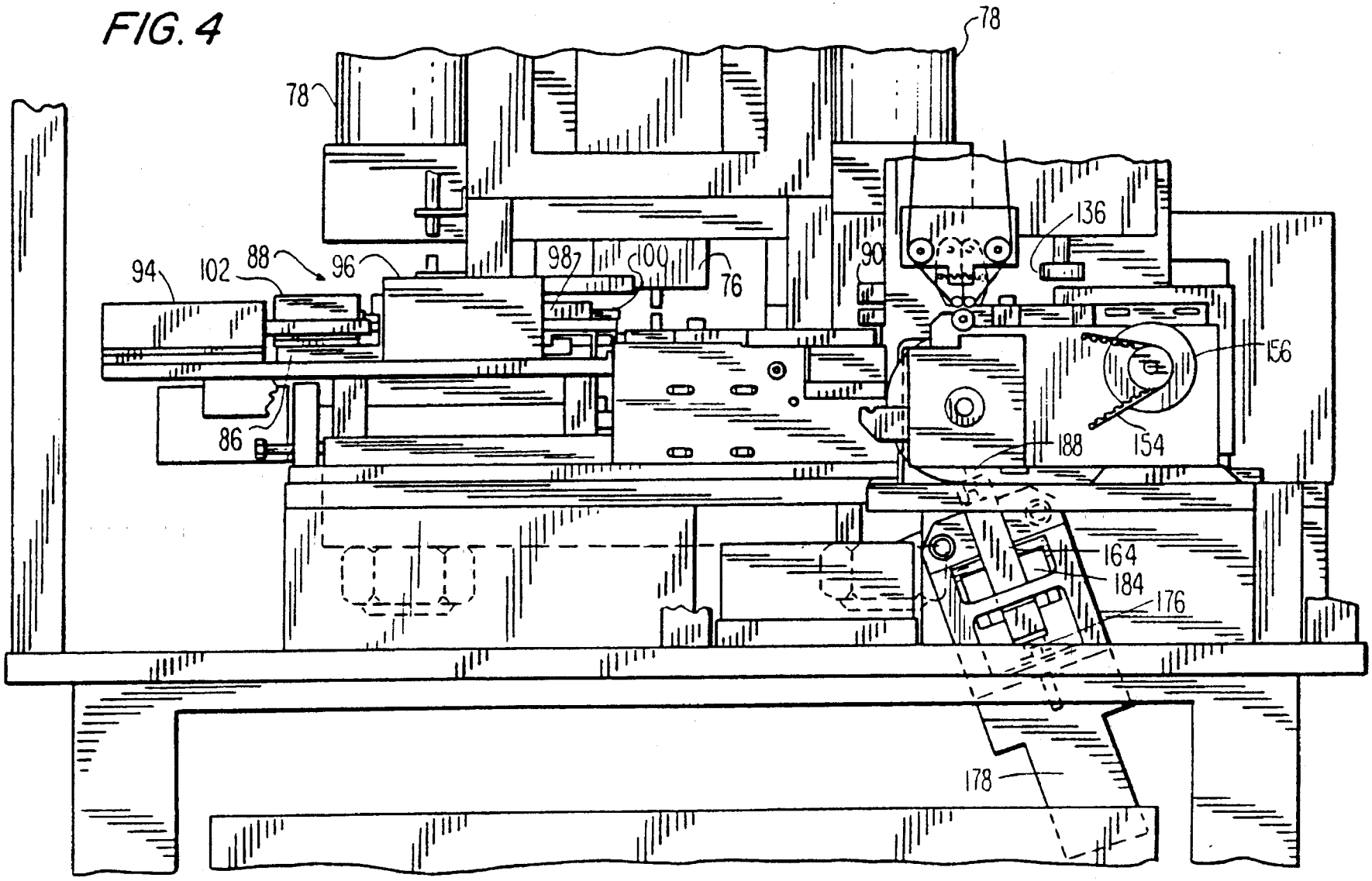
FIG. 4 is a right side elevational view taken along the lines 4—4 of FIG. 1.

Referring now to FIG. 2 in conjunction with FIG. 4, flat press station 14 includes a flat press ram 76 which is slidably mounted on support members 78 and is movable in a vertical direction by means of a hydraulic cylinder 80. The direction of movement of flat press ram 76 and the force applied thereto by hydraulic cylinder 80 are controlled, and can be adjusted, by the computer. Preferably, flat press ram 76, has a vertical range of travel of approximately 3.0 inches. Additionally, hydraulic cylinder 80 can supply a pressure of approximately 10,000 psi to ram 76.

Flat press station 14 further includes a movable alignment plate 82 as shown in FIG. 1. Alignment plate 82 is slidably movable between a first position remote from shuttle member 40 to a second position adjacent shuttle member 40 and beneath ram 76 by means of hydraulic cylinder 84. As shown in FIG. 6, flat press ram 76 engages shuttle halves 44 and 48 to flat press the needle blanks positioned between shuttle die surfaces 46 and 48. Alignment plate 82 is provided to abut drilled end portions of the needle blanks in order to align the ends of the blanks prior to flat pressing.

As noted above, shuttle member 40 is movable along trackway 24 from a second position beneath flat press ram 76 to a third position adjacent transport station 22. While transfer station 20, shuttle member 40 and flat press station 14 are adapted to handle approximately (90) ninety needles at a time, it is preferable during curving and side pressing the needle blanks to process only a few needle blanks at a time to prevent marring of the blanks by adjacent needle blanks during the curving process and to reduce the number of side press die plates required to press the needle blanks. Transport station 22 is provided to remove approximately three needle blanks at a time from shuttle member 40 and transport the needle blanks to curving station 16. Transport station 22 is adapted to cycle approximately thirty times to transport all ninety flat pressed needle blanks carried by shuttle 40. While transport station 22 is adapted to remove three needles at a time, it is within the contemplated scope of the invention to move more or less than three needles at a time.

Referring now to FIGS. 1, 4, 7 and 8, transport station 22 includes a trackway extension plate 86 which is movable in a direction perpendicular to trackway 24, a movable pusher block assembly 88 and a separating mechanism 90 which is similar to separating mechanism 56 described hereinabove. Transport station 22 further includes a transport block 92 located adjacent curving station 16. Trackway extension plate 86 is adapted to receive shuttle member 40 from trackway 24 and move shuttle member 40 along with pusher block assembly 88 towards curving station 16 by means of a stepper motor driven slide 94. Pusher block assembly 88 is movably mounted on plate 86 and includes a pusher block 96 having a pusher extension plate 98 terminating in approximately three pusher fingers 100. Block 96 is moved relative to plate 86 by means of a hydraulic cylinder 102 as shown in FIG. 4.

Figure 7:
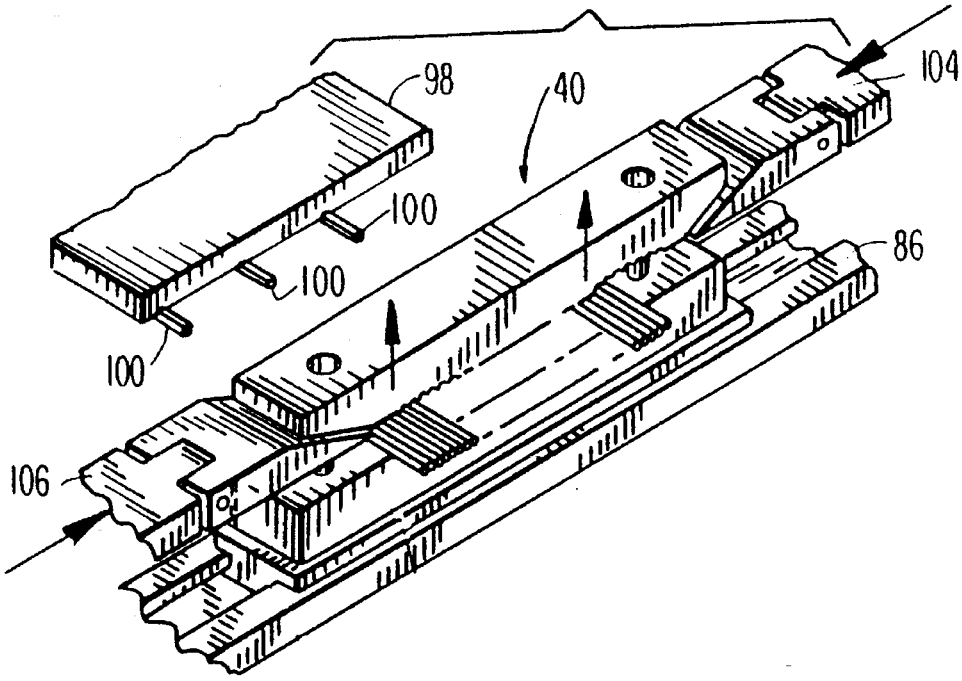
FIG. 7 is an enlarged partial perspective view of the needle transporting section of the apparatus.
Figure 8:
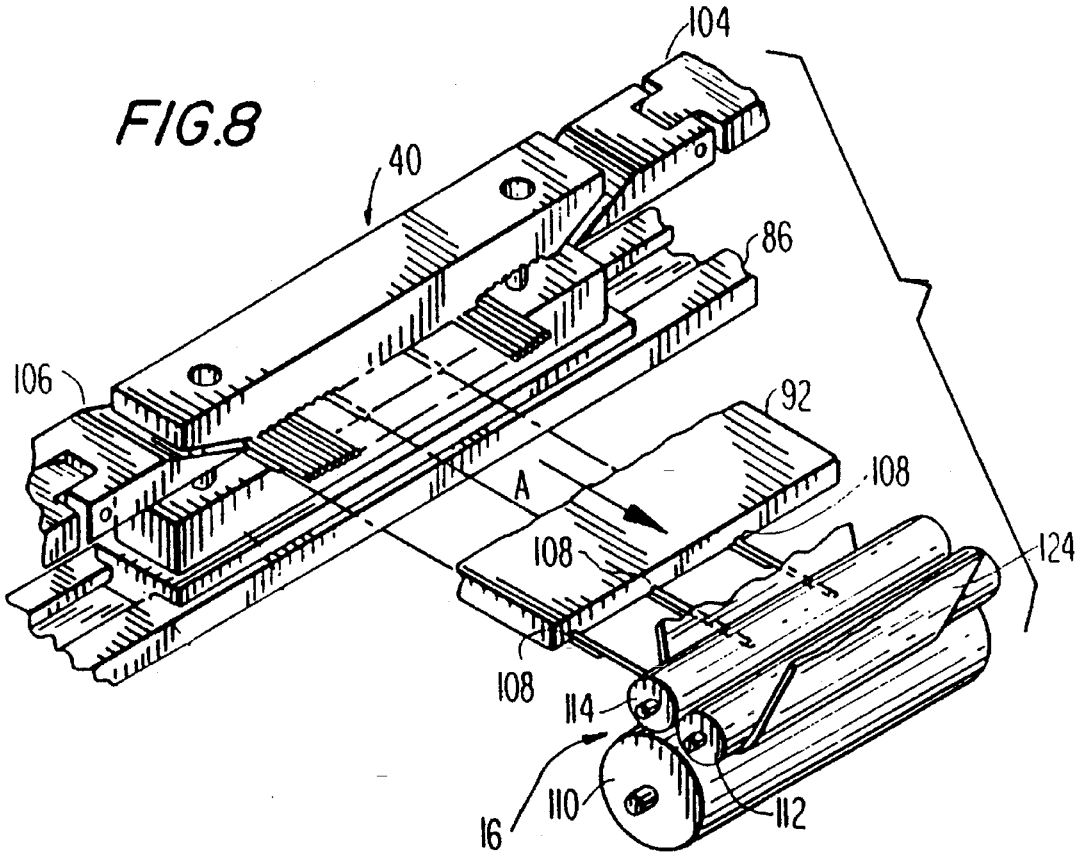
FIG. 8 is an enlarged partial perspective view of the needle transporting section adjacent the curving station of the apparatus.

Referring now to FIGS. 1, 7 and 8 separating mechanism 90 includes jaws 104 and 106 and operates similar to separating mechanism 56. Jaws 104 and 106 close to expand shuttle member halves 44 and 46. Pusher fingers 100 are spaced to engage three needle blanks in separated shuttle member 40 and push the blanks towards an opposite side of shuttle member 40 as pusher block 96 is moved forward by hydraulic cylinder 102. On the side of shuttle member 40 opposite pusher fingers 100 is located transport block 92 having three bores 108 corresponding to the spacing or pitch of the needle blanks in shuttle member 40 and of the pusher fingers 100. As needle blanks are pushed through shuttle member 40 by fingers 100 they are received in bores 108 until portions of the needle blanks extend from bores 108 adjacent curving station 16 as shown in FIG. 8.

Figure 9:
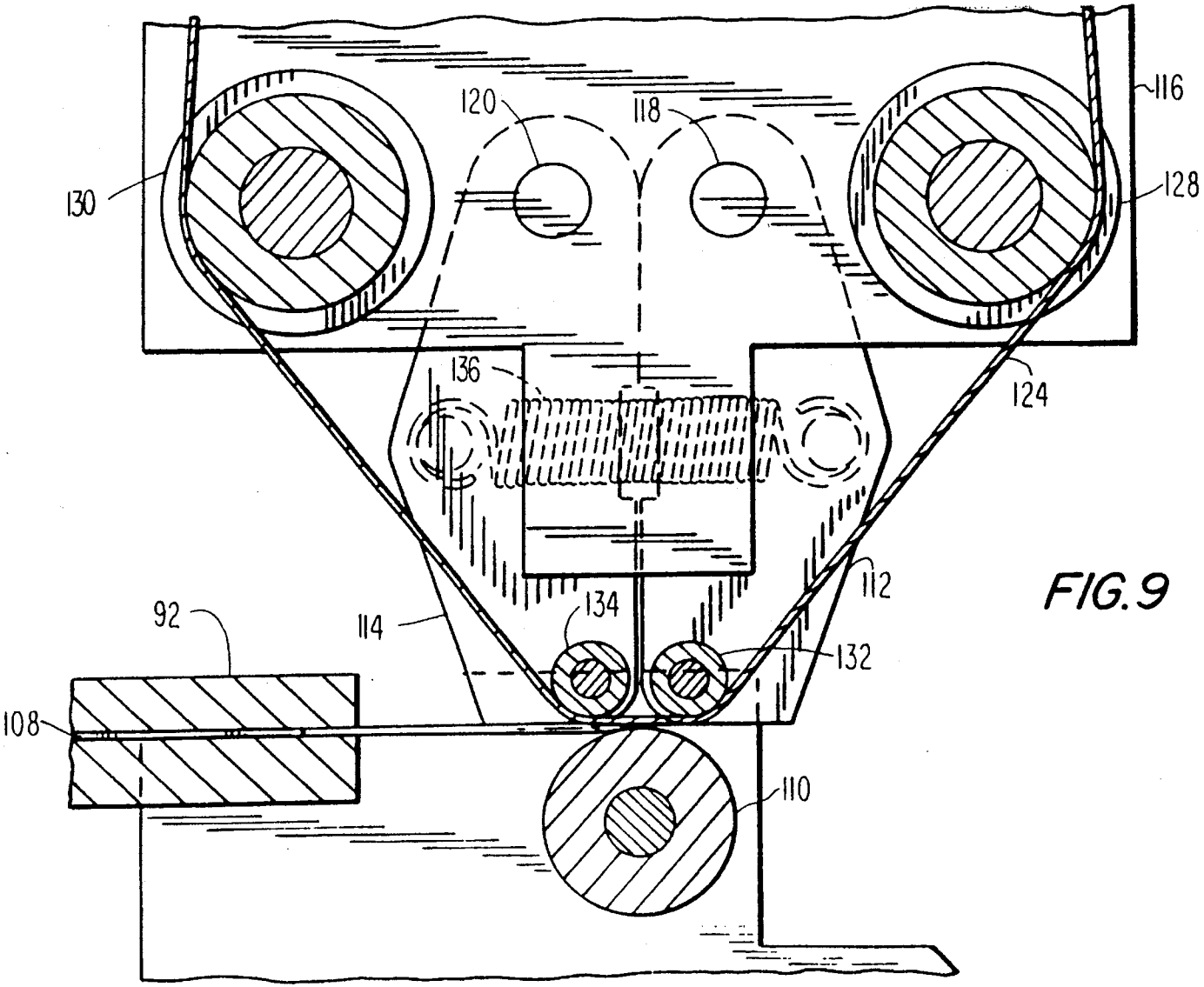
FIG. 9 is an enlarged partial side elevational view illustrating the needle blanks being drawn out of the transport block of the apparatus.

As noted above, and as shown in FIG. 1, pusher block assembly 88 and trackway extension plate 86 are reciprocal between a position remote from curving station 16 and a position adjacent curving station 16 to transfer needle blanks therebetween. Referring now to FIG. 9, needle curving station 16 of the present invention preferably includes a rotatable curving mandrel 110 and right and left needle curving jaws, 112 and 114 respectively. Jaws 112 and 114 are preferably pivotally mounted to a curving ram 116 by means of pivot pins 118 and 120. As shown in FIG. 2, curving ram 116 is reciprocally movable in a vertical direction by means of a hydraulic curving cylinder 122. A curving belt 124 is provided to draw needle blanks out of bores 108 when transport block 92 is positioned adjacent curving mandrel 110. Belt 124 surrounds jaws 112 and 114 at one end and a motor 126 at the other end. Motor 126 may be actuable in clockwise and counterclockwise directions to reciprocate belt 124 about the ends of jaws 112 and 114.

Figure 10:
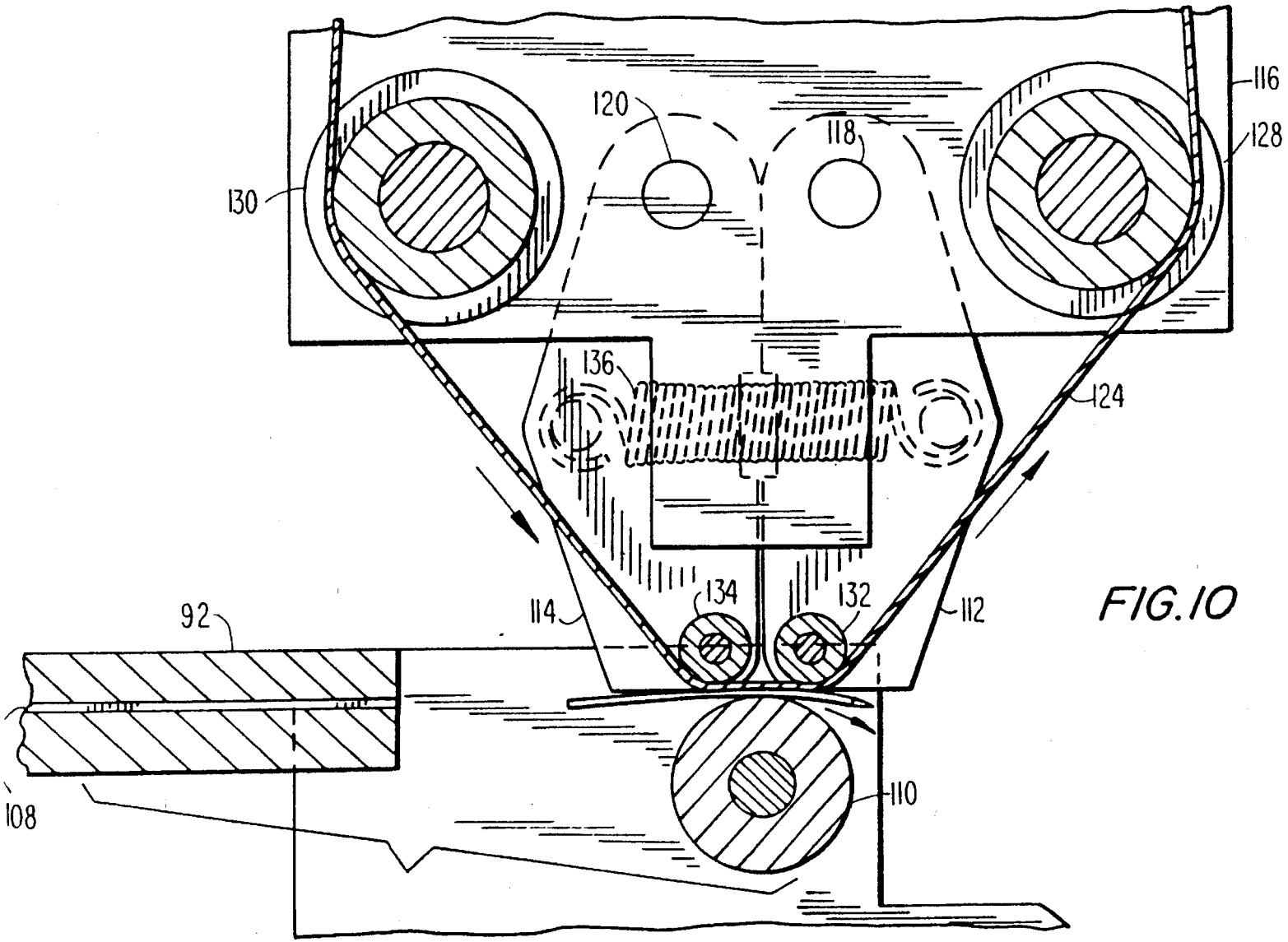
FIG. 10 is an enlarged partial side elevational view of the needle curving station illustrating a needle blank drawn between the curving belt and the curving mandrel of the apparatus.
Figure 11:
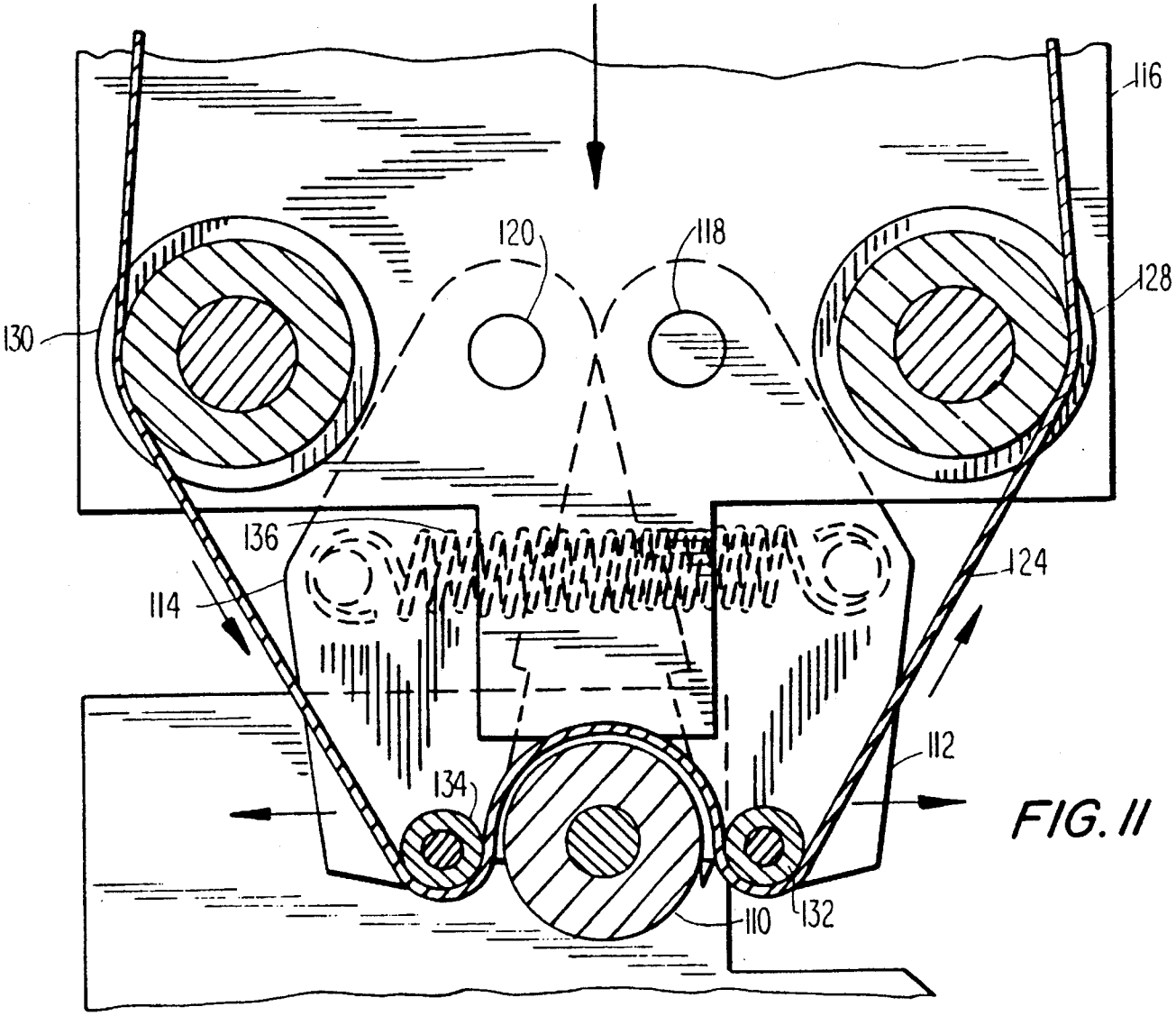
FIG. 11 is an enlarged partial side elevational view illustrating the needle being curved about the mandrel of FIG. 10.

Referring now to FIGS. 9–12, a pair of ram rollers 128 and 130 are rotatably affixed to curving ram 116 to guide and tension belt 124. A pair of jaw rollers 132 and 134 are affixed to jaws 112 and 114, respectively, to guide belt 142 around jaws 112 and 114 and to aid in reciprocating and biasing belt 124 against the needle blanks. Belt 124 is positioned around jaw rollers 132 and 134 on jaws 112 and 114 and ram rollers 128 and 130 on ram 116. As shown in FIG. 9, jaws 112 and 114 are biased together by a spring 136. As shown in FIGS. 9 and 11, jaws 112 and 114 are movable between an initial position where rollers 132 and 134 are adjacent each other and above mandrel 110 to a curving position where ram 116 is biased downward by hydraulic cylinder 122 forcing jaws 112 and 114 open and apart from each other causing jaws 112 and 114 and belt 124 to surround mandrel 110 thereby holding a needle blank therebetween.

Continuing to refer to FIGS. 9–12, mandrel 110 is preferably an elongated shaft or rod positioned transversely with respect to transport block 92. Mandrel 110 has a solid cross-section and is fabricated from a material having a hardness which is at least substantially equal to the hardness of the needle blank material. Typically, mandrel 110 has a rock well hardness value of between about (55 C) and about (57 C) which discourages unwanted shaping or marring of the needle blank and/or mandrel 110. In addition, mandrel 110 may be coated with an elastomer material to help prevent unwanted marring of the needle blank and/or mandrel 110 during the current process.

Preferably, mandrel 110 has a circular cross-section to impart an arcuate profile to the needle blank resulting in a curved surgical needle having a predetermined radius of curvature of between about (0.5") and about (3.0"). However, surgical needles requiring different arcuate profiles require various shaped mandrels, such as elliptical, triangular, rectangular, or pair-shaped mandrels which impart a predetermined curvature to the needle blanks. The diameter of the preferred circular mandrel is dependent on numerous factors including the length of the needle blank desired radius of curvature, and the spring back characteristics of the needle material, i.e., the tendency of the needle material to return to its original shape after being deformed. To illustrate, larger diameter mandrels produce a larger radius of curvature and smaller diameter mandrels produce a smaller radius of curvature. Further, in instances where the needle blank is fabricated from a material having spring back tendencies, the mandrel diameter should be smaller than the desired radius of curvature so that the needle will spring back to the desired radius of curved after bending. The apparatus of the present invention is configured to accommodate mandrels with various diameters necessary for curving surgical needles of various sizes.

As shown in FIG. 4, a belt tension adjustment knob 136 may be provided to adjust the tension of belt 124 around jaws 112 and 114. Specifically as jaws 112 and 114 are moved up and down by ram 116, belt 124 may stretch or otherwise become elongated. Belt tension adjustment knob 136 allows for vertical adjustment of motor 126 to compensate for elongation of belt 124. Further, a jaw stop adjustment knob (not shown) may also be provided to limit the vertical downward movement of ram 124 and thus of jaws 112 and 124 about curving mandrel 110.

As can be seen in FIGS. 8–10, needle curving station 16 is adapted to receive needle blanks directly from transport block 92. This is done by reciprocating plate 98 to position block 92 adjacent mandrel 110 and belt 124 and rotating belt 124 to draw the needle blanks between mandrel 110 and the belt 124. In this manner a needle blank is transported from shuttle 28 to curving mandrel 110 of curving station 16.

Figure 13:
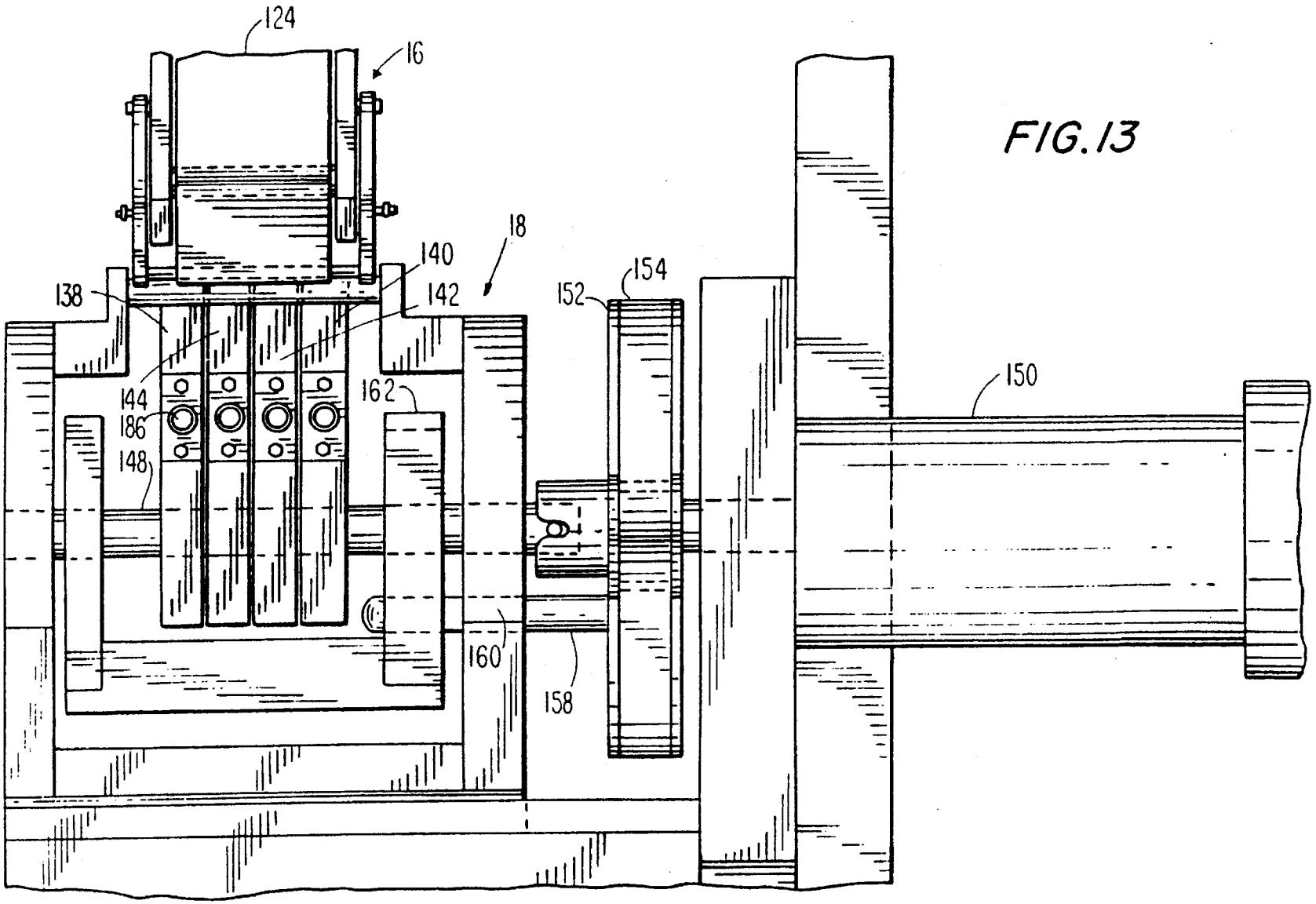
FIG. 13 is an enlarged partial end elevational view of the curving and side press stations of the apparatus.

Referring now to FIG. 13, needle side press station 18 includes a plurality of side press die plates adapted to receive needle blanks from curving station 16 and hold them for side pressing within side press station 18. Side press station 18 is provided with a pair of end side press die plates 138 and 140 having die grooves 146 (FIG. 14) on an inner surface only thereof and two center side press die plates 144 and 142, each having die grooves 146 on both exterior faces. Side press die plates 138, 140, 142 and 144 are mounted with respect to an indexing shaft 148 which is adapted to rotate die plates 138, 140, 142 and 144 between a first position adjacent curving station 16 to a second position for side pressing. Indexing shaft 148 is rotated by a stepper type motor 150 via a drive wheel 152 and a drive belt 154. Drive belt 154 surrounds drive wheel 152 at one end and a drive pulley 156 (FIG. 4) at another end. Pulley 156 is connected to stepper motor 150 for rotation therewith. A cam rod 156 extends outward from drive wheel 153 and engages a groove 160 in a side press die carriage 162. Indexing shaft 148 may also include means to bring die plates 138, 140, 142 and 144 together to hold needle blanks therebetween and to separate the die plates to accept and release needle blanks.

Figure 14:
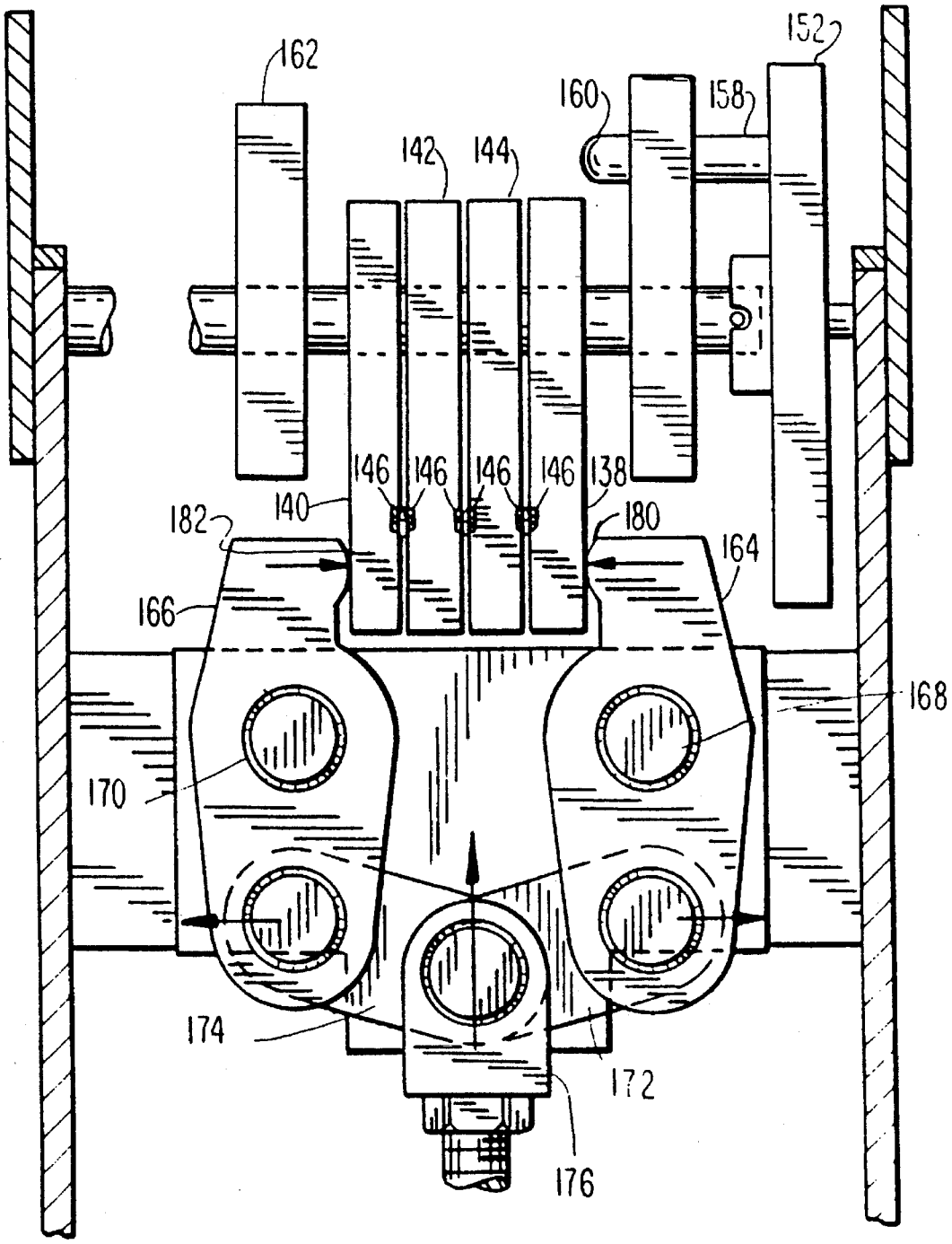
FIG. 14 is an end view of the side press station illustrating the side press dies positioned between the clamping members.
Figure 18:
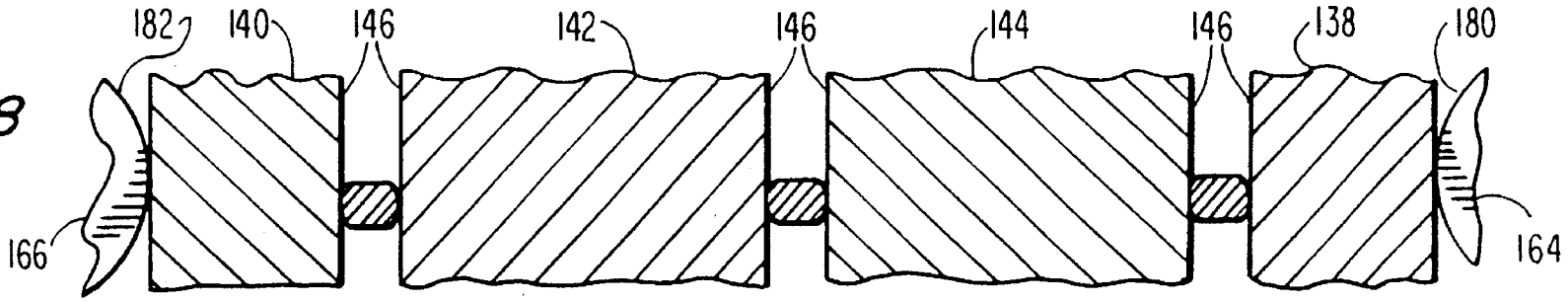
FIG. 18 is an enlarged partial cross-sectional view of the side press station illustrating the needle blanks positioned between the side press die plates.
Figure 19:
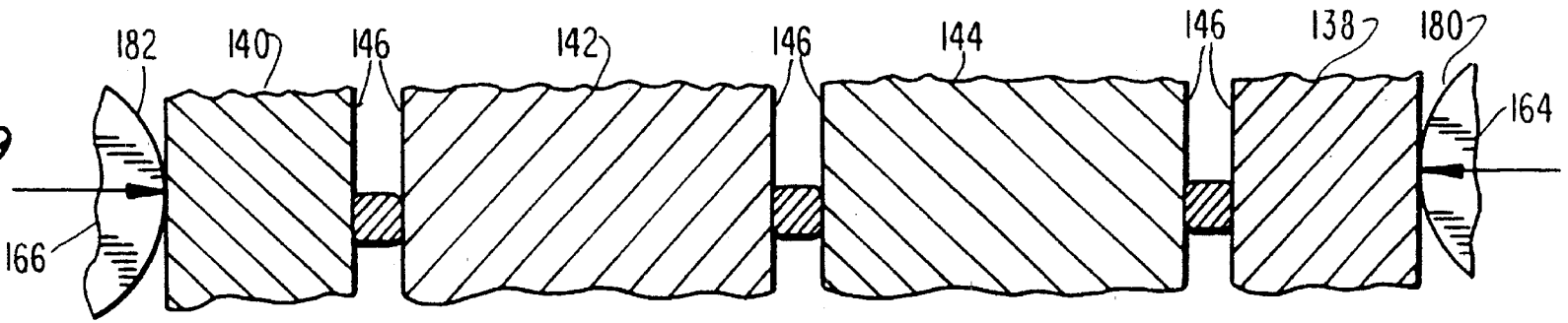
FIG. 19 is an enlarged partial cross-sectional view similar to FIG. 17, illustrating the needle blanks being side pressed between the side press dies.

Referring now to FIG. 14, it can be seen that side press station 18 further includes a pair of side die rams 164 and 166 which are pivotally supported by pivot pins 168 and 170. A pair of toggle links 172 and 174 are pivotally affixed at one end of side die rams 164 and 166. Toggle links 122 and 124 overlap at one end thereof and are connected to a drive shaft 176. Drive shaft 176 is reciprocally movable by means of a hydraulic cylinder 178 (FIG. 4). By advancing drive shaft 176 toggle links 172 and 174 force side die rams 164 and 166 outward to pivot die rams 164 and 166 around pivot pins 168 and 170 thus forcing the opposite ends of the die rams to compress inwardly. The ends of side die rams 164 and 166 opposite toggle links 172 and 174 are provided with inwardly directed ends 164 and 166. As shown specifically in FIGS. 14 and 18, inward movement of inwardly directed ends 180 and 182 of side die rams 164 and 166 compresses side die plates 138, 140, 142 and 144 about needle blanks positioned within needle die grooves 146.

Die plates 138, 140, 142 and 144 are rotatable with respect to side press die carriage 162 and are rotatably between a first position where die grooves 146 are adjacent needle curving station 16 to a second position where die plates 138 and 140 are positioned between side die rams 164 and 166 for side pressing therebetween. Furthermore, after side pressing, side press die plates 138, 140, 142 and 144 are movable between the second position and a third position adjacent a needle receptacle 184 (FIG. 4). Opening and separating of die plates 138, 140, 142 and 144 allows needle blanks to fall into receptacle 184. Side press die plates 138, 140, 142 and 144 may each be provided with blow holes 186 (FIG. 13) which are communicable between an outside surface of the die plates and needle die grooves 146. When carriage 162 is rotated to position the die plates in the third position, blow holes 186 align with an air manifold 188. Means are provided for forcing a flow of air through manifold 188 and thus through blow holes 186 to urge needle blanks from die grooves 146 into receptacle 184 after die plates 138, 140, 142 and 144 have been separated back apart.

Turning now to the operation of needle forming apparatus 10, needle blanks which have been already drilled and tapered are contained in needle holding or grinding cartridge 26. Needle blanks initially contained in needle cartridge 26 are transferred to the shuttle cartridge 40. As can be seen in FIGS. 3 and 5, needle cartridge 26 is initially placed on needle cartridge block 28 of apparatus 10. Block 28 is advanced to position cartridge 26 adjacent shuttle cartridge 40. A lever pusher 37 is provided to move lever means 38 in order to open jaws 36 and 32 to free up or release the needle blanks. A hydraulic cylinder 39 is provided to advance and retract lever pusher 37. In the alternative, a pneumatic cylinder (not shown) may be employed rather than the hydraulic cylinder.

As shown in FIGS. 3 and 5, plate 64 containing the separating mechanism 56 is advanced toward shuttle member 40 by means of hydraulic cylinder 66. In the alternative, a pneumatic cylinder (not shown) may be employed rather than the hydraulic cylinder. At this point jaws 58 and 60 of separating mechanism 56 surround ends of shuttle member 40 and are driven in between lower half 46 and upper half 48 of shuttle member 40 by means of hydraulic cylinder 62 to separate halves 46 and 48 apart against the bias of springs 54. At this point block 28 containing needle holding clamp 26 is advanced further to position the needle blanks between the now separated halves 46 and 48. Lever pusher 37 is advanced by means of hydraulic cylinder 39 to open lever 38 of the needle holding clamp which releases the needle blanks from the grasp of jaws 32 and 36. Separating jaws 68 and 60 are then pulled out and away from shuttle halves 46 and 48 allowing shuttle halves 46 and 48 to clamp down on the needle blanks by means of spring 54. Block 28 and needle holding clamp 26 are then retracted away from shuttle member 40. Open jaws 58 and 60 are retracted by means of plate 64 and hydraulic cylinder 66 to clear the way for shuttle member 40 to slide down trackway 24. In this manner a plurality of needle blanks are transferred from a needle holding or grinding clamp 26 into a shuttle cartridge 40.

Referring now to FIGS. 1, 2 and 6, shuttle member 40 is moved down trackway 24 towards a position adjacent flat press station 14 by means of belt 68 which is driven by motor 72. As shown in FIG. 1, once shuttle member 40 is positioned within flat press die station 14, an alignment block 82, advanced by hydraulic cylinder 84, moves towards shuttle 40 to align the drilled end portions of the needle blanks. In the alternative, a pneumatic cylinder (not shown) may be employed rather than hydraulic cylinder 84. This is to insure consistent forming of the barrel portions of the needle blanks by maintaining the alignment of the drilled end portions with respect to plate member 82. Referring now to FIGS. 2 and 6, hydraulic cylinder 80 (FIG. 2) can now drive ram 76 down to compressed needle blanks between die surfaces 46 and 50 of shuttle cartridge halves 44 and 48 to flat press the barrel portions of needle blanks contained therein. Preferably, there are approximately 90 needle blanks removed from grinding cartridge 26 and placed in shuttle member 40 for flat pressing in flat press station 14. Hence apparatus 10 is capable of flat pressing as many as approximately 90 needle blanks at a time.

Once the needle blanks within shuttle cartridge 40 have been flat pressed, shuttle cartridge 40 may be advanced further down trackway 24 to a position adjacent transport station 22. Transport station 22 is adapted to remove approximately three needle blanks from the shuttle member 40 to continue processing of approximately three needle blanks through curving station 16 and side press station 18 of the apparatus 10. As shown in FIG. 1, shuttle cartridge member 40 is advanced onto a trackway extension plate 86 which is movable in a direction substantially perpendicular to trackway 24. Extension plate 86 is advanced towards curving station 16 by means of hydraulic cylinder 94. By moving extension plate 86 towards curving station 16, shuttle member 40 is positioned between jaws 104 and 106 of separating mechanism 90. As with separating mechanism 56 above, jaws 104 and 106 of separating mechanism 90 are adapted to separate upper and lower halves 44 and 46 of shuttle member 40 to free the needles contained therein.

As shown in FIGS. 4, 7 and 8, pusher block 96 is moved forward by hydraulic cylinder 102 to move extension plate 98 containing pusher fingers 100 adjacent a first side of shuttle cartridge 40. In the alternative, a pneumatic cylinder (not shown) may be employed instead of hydraulic cylinder 102. Transport block 92 is positioned adjacent an opposite side of shuttle block 40. At this point further advancement of pusher block 96, and thus of fingers 100, in the direction of Arrow A (FIG. 8), advances approximately three needle blanks at a time out of shuttle member 40 and into bores 108 of transport block 92. Shuttle member 40 then advances along trackway extension plate 86 approximately the distance of the pitch of one needle blank to position figures 100 behind the next three needle blanks contained in shuttle member 40. Block 96 is again advanced to push three more needles into bores 108 of transport block 92 and the cycle is repeated until three needle blanks project out the ends of transport block 92. At this stage extension plate 86 is advanced slightly further to position the now projecting needle blanks adjacent curving station 16 for receipt between mandrel 110 and curving belt 124. It will be noted that transport station 22 can sequentially remove groups of three needles at a time for advancement into curving station 16 and onto side press station 18. By advancing shuttle member 40 along trackway extension 86 the amount of the pitch of one needle, each cycling of transporting station 22 will remove three needle blanks from shuttle member 40. As noted above, shuttle member 40 can contain as many as ninety needle blanks, thus approximately 30 cycles of transport station 22 will completely unload all the needle blanks in shuttle member 40 and transport them to curving station 16 for further processing.

Referring now specifically to FIGS. 9 and 10, it can be seen that after flat pressing the needle blanks, transport station 22 removes the needle blanks from shuttle 40 and advances the needle blanks to a position adjacent belt 124 and mandrel 110 as best shown in FIG. 9. At this point belt 124 is rotated slightly in the direction of arrows B (FIG. 10) to draw the needle blanks out of bores 108 and to position the needle blanks between belt 124 and mandrel 110.

The curving sequence of curving station 16 will now be described specifically with reference to FIGS. 10 and 11. Once needle blanks have been drawn between mandrel 110 and belt 124, and transport block 92 has been retracted in the direction of arrow C, ram 116 is forced downward in the direction of arrow D by hydraulic cylinder 122 (FIG. 1) to force open jaws 112 and 114 (arrows E) against the tension of spring 136. The downward motion of ram 116 causes belt 128 to move down and around the needle blanks and mandrel 110 as shown in FIG. 11. At this point belt 124 is reciprocated back and forth through a slight motion by means of motor 126 to curve needle blank about mandrel 110. Rollers 128, 130, 132 and 134 insure belt 124 rotates needle blanks smoothly about curving mandrel 110. Belt 124 and jaws 112 and 114, as tensioned by spring 136, are sufficiently resilient to insure that the needle blanks are merely curved about mandrel 110 and are not compressed or flat pressed to any significant extent. This insures that a drilled end portion and a tapered end portion of the needle blanks are not deformed during the curving process between belt 124 and mandrel 110.

Figure 12:
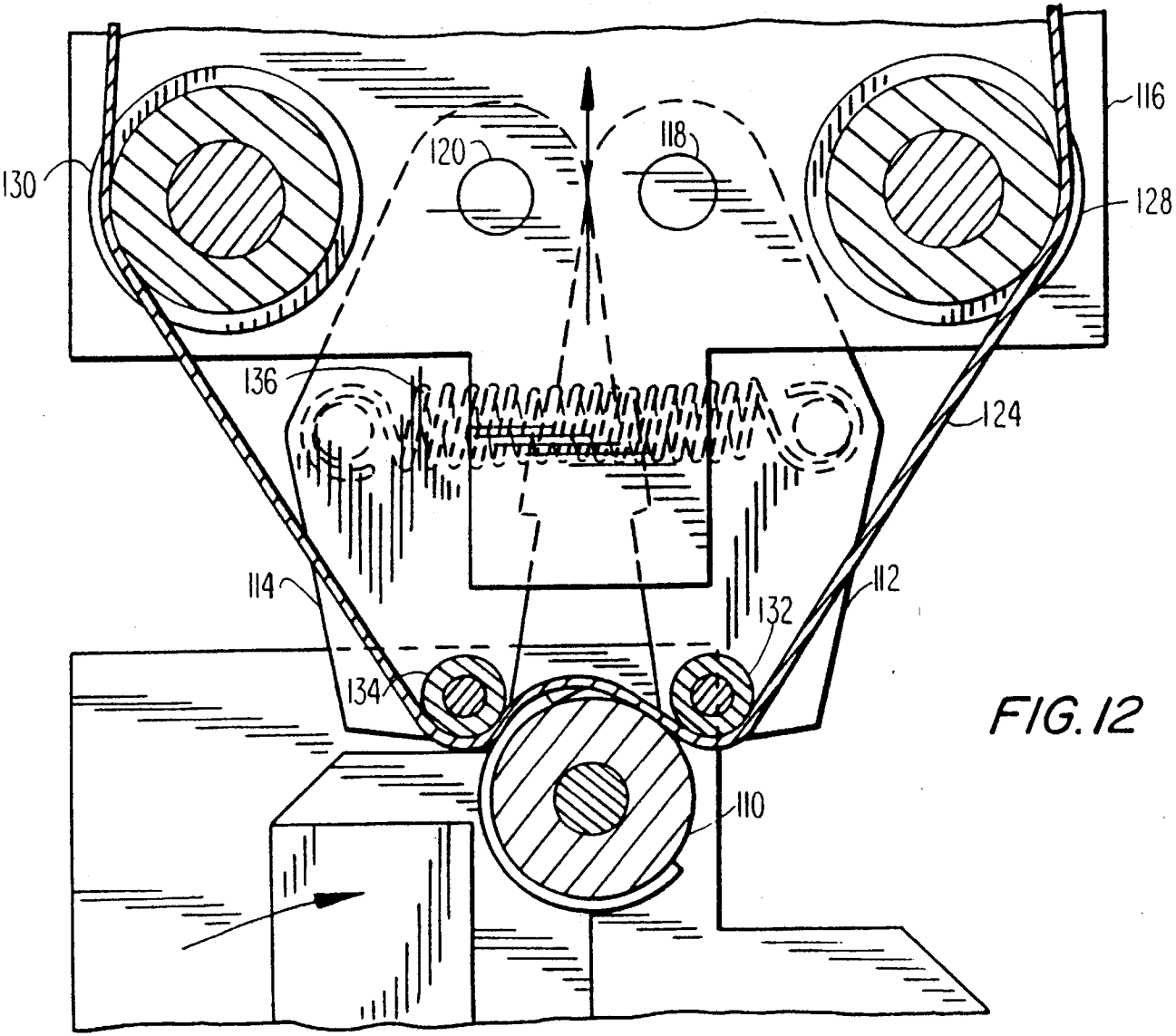
FIG. 12 is an enlarged partial side elevational view showing the needle being rotated for acceptance by the side die plates.

Referring now to FIGS. 12 and 13 it can be seen that as belt 124 is further rotated, the needle blanks are rotated about mandrel 110 thus positioning the needle blanks for deposit in needle die grooves 146 of side press die plates 138, 140, 142 and 144. As noted above, side press die plates 138, 140, 142 and 144 are rotatable to a first position adjacent to curving station 16. At this point the plates are expanded slightly to make room for the needle blanks within needle grooves 146. Belt 124 rotates the needle blanks into die grooves 146. Die plates 138, 140, 142 and 144 are then compressed slightly to hold the needle blanks within die grooves 146. In this manner, the flat pressed and curved needle blanks are carried from a needle grinding or holding clamp through flat press and curving stations 14 and 16, respectively, to side press station 18 without having to remove the needle blanks from needle forming apparatus 10. As noted above, this continuous handling of the needle blanks between flat press station 14, curving station 16 and side press station 18 insures consistent and reliable forming of needle blanks. This is especially true where, as here, the needle blanks are off loaded from a needle grinding clamp directly into apparatus 10.

Referring now to FIG. 14, side press die plates 138, 140, 142 and 144 are now pivoted to a position between side rams 164 and 166. Actuation of hydraulic cylinder 178 drives die shaft 176 upwardly forcing toggle links 172 and 174 to pivot side press die rams 164 and 166 about pivot pins 168 and 170 thereby forcing ends 180 and 182 of side press dies 164 and 166, respectively, against side press die plates 138 and 140 compressing plates 138 and 140 together to side press needles captured in needle die grooves 146. Side press die plates 94, 95, 96 and 97 may also be provided with lead in tapers, i.e., areas of the die faces which provide a clearance for the drilled and tapered end portions of the needle blanks, to insure that the drilled end portions and tapered end portions are not deformed during the side press operation. These lead in tapers may be approximately on the order of between 3 and 15 degrees and preferably on the order of about 5 degrees. Hydraulic cylinder 178 can compress side press rams 120 and 121 with a force of about 100 to 10,000 psi and preferably about 500 psi.

After the needle blanks are side pressed between die plates 138, 140, 142 and 144 by side die rams 164 and 166, side press die carriage 162 can be rotated to the third position thereby positioning blow holes 186 on plates 138, 140, 142 and 144 adjacent air manifold 188. Die plates 138, 140, 142 and 144 are expanded slightly and air is injected through manifold 188, and thus through blow holes 186, to urge or force the needle blanks out of die grooves 146 into needle blank receptacle 184. Needle blank receptacle 184 is preferably formed of a plastic coated, i.e., polymer, material to insure that needle blanks deposited therein are not deformed during ejection of the needles from die grooves 146.

The needle forming apparatus 10 of the present invention is particularly adapted to transport a plurality of tapered and drilled needle blanks from an initial position on needle grinding or holding clamp 26 into shuttle member 40, through flat press station 14, curving station 16 and side press station 18 and then into receptacle 184 without having to remove the needles from apparatus 10.

Figure 20:
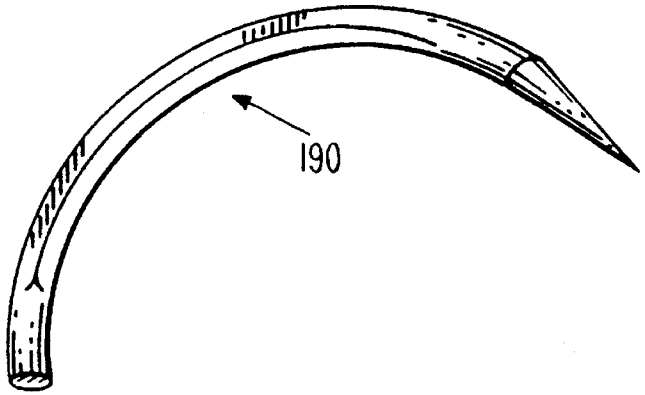
FIG. 20 is a perspective view of a needle formed by the needle forming apparatus of the present invention.

The continuous flow of needle blanks through apparatus 10 is best illustrated in FIGS. 12 through 16. As noted above, needle blanks are transferred from cartridge 26 to shuttle member 40, down track 24 to a position beneath ram 76, which then flat presses opposite sides of the needle blanks in shuttle member 40 as shown in FIG. 13. As noted above, the needle blanks are then advanced to a position adjacent curving station 16 by transport station 22 wherein belt 124 draws the needles out of bores 108 in transport block 92 and reciprocally curves them about mandrel 110 as shown in FIG. 11. After curving about mandrel 110, the needles are then rotated beneath mandrel 110 and deposited between side press die plates 138, 140, 142 and 144 as shown in FIG. 13. The needle blanks are then compressed between die plates 138, 140, 142 and 144 by means of ends 180 and 182 of rams 164 and 166 as shown in FIG. 14. After side pressing, the resulting needle blanks are curved and have a rectangular cross section thus forming curved rectangular bodied needles. An illustration of a curved rectangular bodied needle 190 formed by the needle forming apparatus 10 is best illustrated in FIG. 20.

It will be understood that various modifications can be made to the embodiments of the present invention herein disclosed without departing from the spirit and scope thereof. For example, various sizes of the instrument are contemplated, as well as various types of construction materials. Also, various modifications may be made in the configuration of the parts. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. An apparatus for forming surgical needles which comprises:

a) a frame portion;

b) a shuttle member having an upper half and a lower half, said upper and lower halves biased together and adapted to hold needle blanks between inner surfaces of said upper and lower halves:

c) a needle holder detachably mounted on said frame portion, said needle holder supplying the needle blanks to said shuttle member;

d) a transferring mechanism, associated with said shuttle member and said needle holder, said transferring mechanism transferring the needle blanks from said needle holder to said shuttle member: and e) a flat press engagable with said shuttle member, said flat press imparting first flat surfaces to first opposing sides of the needle blanks, wherein said shuttle member is movable from a first position adjacent said transferring mechanism to a second position adjacent said flat press.

2. The apparatus as recited in claim 1, wherein said shuttle member is reciprocally slidable along a trackway.

3. The apparatus as recited in claim 1, wherein said shuttle member is adapted to hold approximately ninety needle blanks.

4. The apparatus as recited in claim 1, wherein said upper and lower halves of said shuttle member have die surfaces on said inner surfaces, said die surfaces adapted to engage only barrel portions of the needle blanks.

5. The apparatus as recited in claim 4, wherein said flat press engages said upper and lower halves of said shuttle member to impart the first flat surfaces to the barrel portions of the needle blanks engaged by said die surfaces.

6. The apparatus as recited in claim 1, wherein said transferring mechanism includes:

a) a first separator engagable with said upper and lower halves of said shuttle member to separate said upper and lower halves;

b) a positioner engagable with the needle blanks, said positioner moving the needle blanks between said inner surfaces of said separated upper and lower halves; and c) a release mechanism associated with said needle holder, said release mechanism releasing the needle blanks from said needle holder, such that when said first separator is removed from said upper and lower halves of said shuttle member, said upper and lower halves grip the needle blanks positioned therebetween.

7. The apparatus as recited in claim 6, wherein said positioner includes a moving mechanism, said moving mechanism moving said needle holder from a position remote from said shuttle member to a position adjacent said shuttle member, such that portions of the needle blanks are between said upper and lower halves when the needle blanks are moved adjacent said shuttle member.

8. The apparatus as recited in claim 7, wherein a) said needle holder includes a detachable clamp member having an upper jaw, a lower jaw and lever means for moving said upper jaw with respect to said lower jaw; and b) said release mechanism includes means for moving said lever means, such that when said lever means is in a first position, the needle blanks are firmly clamped between said upper and lower jaws of said clamp member and when said lever means is moved to a second position by said moving means, the needle blanks are releasably supported by said lower jaw.

9. The apparatus as recited in claim 1 which further comprises:

a) a curving station associated with said frame portion, said curving station configured to impart a curved profile to the needle blanks; and b) a transporter, said transporter moving said needle blanks between said shuttle member and said curving station, wherein said shuttle member is movable from a second position adjacent said flat press to a third position adjacent said transporter.

10. The apparatus as recited in claim 9, wherein said transporter includes, a) a second separator, said second separator separating said upper and lower halves of said shuttle member;

b) a remover mechanism, said remover mechanism removing the needle blanks from said shuttle member; and c) a second positioner, said second positioner moving the needle blanks adjacent said curving station.

11. The apparatus as recited in claim 10 wherein said remover mechanism includes a movable plate member having a plurality of needle pushing fingers along one edge thereof, said plate member movable from a position remote from said shuttle member to a position adjacent a first side of said shuttle member such that said fingers push a plurality of the needle blanks toward a second side of said shuttle member.

12. The apparatus as recited in claim 11, wherein said second positioner includes a movable block member having a plurality of transverse bores therein, said block member movable from a first position adjacent said second side of said shuttle member for receipt of the needle blanks therefrom within said bores to a second position adjacent said curving station, wherein the needle blanks are pushed by said needle pushing fingers out of said shuttle member and into said bores when said block-member is adjacent said second side of said shuttle member.

13. The apparatus according to claim 9, wherein said curving station includes a mandrel, said mandrel imparting an arcuate profile to at least a portion of the needle blanks; and a reciprocating mechanism, said reciprocating mechanism biasing and reciprocally moving the needle blanks against said mandrel.

14. The apparatus according to claim 13, wherein said reciprocating mechanism cooperates with said mandrel to accept the needle blanks therebetween from said transporter, wherein said mandrel includes a rotatable shaft having at least a portion thereof configured to impart said arcuate profile to the needle blanks.

15. The apparatus according to claim 14, wherein said portion of said shaft comprises a curvature having a predetermined radius, wherein said predetermined radius is in the range of between about 0.05 inches and about 3.00 inches.

16. The apparatus according to claim 13, wherein said reciprocating mechanism includes:

at least one pair of rotatable members positioned in adjacency; and a belt positioned about said at least one pair of rotatable members, said belt biasing and reciprocally moving the needle blanks against sa 17. The apparatus according to claim 16, wherein said reciprocating mechanism further includes a belt driver, said belt driver selectively moving said belt, said reciprocating mechanism further including a tensioner for applying tension to said belt, wherein said tensioner includes at least one tensioning roller biased toward said belt and, wherein said belt is an elastic belt.

18. The apparatus according to claim 16, wherein said curving station further includes a biasing mechanism, said biasing mechanism applying a continuous force to at least one of said pair of rotatable members such that a friction fit is maintained between said belt, said at least one pair of rotatable members and the needle blanks when said belt is engaged with said reciprocating mechanism.

19. The apparatus according to claim 9, which further comprises a side press station associated with said frame portion, said side press station imparting second flat surfaces to opposing sides of the needle blanks, wherein said second flat surfaces are imparted substantially perpendicular to said first flat surfaces.

20. The apparatus according to claim 19, wherein said side press station includes a plurality of side dies, said side dies supporting the needle blanks and a clamp mechanism, said clamp mechanism pressing said side dies about the needle blanks to impart said second flat surfaces.

21. The apparatus according to claim 20, wherein said side dies comprise a plurality of adjacent plate members, each said adjacent plate member having at least one die slot coacting with a corresponding die slot in an adjacent plate member to support a needle blank therebetween.

22. The apparatus according to claim 21, wherein said corresponding die slots have lead in tapers of about 3° to about 15°.

23. The apparatus according to claim 21, wherein said side dies are rotatable between said second position adjacent said clamp mechanism to a third position removed from said clamp mechanism, and further comprising an urging mechanism, said urging mechanism removing the needle blanks from said side dies when said side dies are in said third position.

24. The apparatus according to claim 23, wherein said urging mechanism includes an air jet to urge the needle blanks free from said side dies.

25. The apparatus according to claim 20, wherein said side dies are rotatable between a first position adjacent said curving station for direct receipt of the needle blanks therefrom to a second position adjacent said clamp mechanism for side pressing the needle blanks therebetween.

26. A method of forming curved rectangular bodied needles from substantially round-elongated needle blanks comprising the steps of:

a) transferring needle blanks from a clamp to a holding shuttle having die surfaces on needle engaging faces thereoff;

b) flat pressing first opposing sides of the needle blanks between said die surfaces;

c) transporting the needle blanks from said shuttle onto a rotatable mandrel;

d) curving the needle blanks between said rotatable mandrel and a reciprocable belt;

e) rotating the needle blanks about said mandrel and adjacent side press dies and depositing the needle blanks therebetween; and f) side pressing second opposing sides of the needle blanks between said side press dies, the second opposing sides of the needle blanks being substantially perpendicular to the first flat pressed opposing sides.

27. The method according to claim 26, wherein said transferring step comprises:

a) separating an upper needle clamping half and a lower needle clamping half of said shuttle against a spring bias by wedging said upper and lower halves apart;

b) advancing a needle holding clamp, having ends of needle blanks clamped therein, adjacent said shuttle member such that projecting portions of the needle blanks are positioned between said upper and lower halves of said shuttle member;

c) unclamping said needle holding clamp to free the ends of the needle blanks from said clamp; and d) clamping said upper and lower halves together, said upper and lower halves being forced together by said spring bias to clamp the portions of the needle blanks located therebetween.

28. The method according to claim 26, wherein said flat pressing step comprises:

a) positioning the needle blanks on said needle engaging faces of said shuttle;

b) advancing said shuttle adjacent an upper flat press member; and c) compressing the needle blanks between said die surfaces of said shuttle by an upper flat press member and a lower flat press member.

29. The method according to claim 26, wherein said transporting step comprises:

a) wedging open upper and lower needle clamping halves of said shuttle against a spring bias to release the needle blank clamped therebetween;

b) advancing a pusher member having a plurality of needle pushing fingers adjacent said shuttle to push a plurality of needle blanks out of said shuttle and into bores of a needle transporting block such that ends of the needle blanks project outward of said bores from a side of said block opposite said pusher member; and c) moving said transport block adjacent said rotatable mandrel such that the projecting ends of the needle blanks abut said rotatable mandrel.

30. The method according to claim 29, wherein said curving step comprises:

a) drawing the needle blanks out of said transporting block between said mandrel and said belt by advancement of said belt; and b) pressing said belt against the needle blanks and reciprocating said belt to form the needle blanks about said rotatable mandrel.

31. The method of claim 26, wherein said side pressing step comprises:

a) capturing the needle blanks between a plurality of adjacent die plates;

b) rotating said die plates between a pair of clamp members; and c) clamping said die plates about the needle blanks by squeezing said clamp members against said die plates.

* * * * *